US010801155B2

(12) United States Patent
Kim et al.

(10) Patent No.: US 10,801,155 B2
(45) Date of Patent: Oct. 13, 2020

(54) WASHING MACHINE

(71) Applicant: Samsung Electronics Co., Ltd, Gyeonggi-do (KR)

(72) Inventors: Jin Doo Kim, Gyeonggi-do (KR); Seung Wan Yoo, Gyeonggi-do (KR); Yong Joon Jang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 72 days.

(21) Appl. No.: 15/128,097

(22) PCT Filed: Mar. 18, 2015

(86) PCT No.: PCT/KR2015/002634
§ 371 (c)(1),
(2) Date: Sep. 21, 2016

(87) PCT Pub. No.: WO2015/142058
PCT Pub. Date: Sep. 24, 2015

(65) Prior Publication Data

US 2017/0107656 A1 Apr. 20, 2017

(30) Foreign Application Priority Data

Mar. 21, 2014 (CN) ..... 10-2014-0033494
Mar. 21, 2014 (CN) ..... 10-2014-0033572
Nov. 26, 2014 (CN) ..... 10-2014-0166185

(51) Int. Cl.
*D06F 39/02* (2006.01)
*D06F 39/08* (2006.01)
*D06F 37/04* (2006.01)

(52) U.S. Cl.
CPC ..... *D06F 39/022* (2013.01); *D06F 39/087* (2013.01); *D06F 37/04* (2013.01); *D06F 39/088* (2013.01)

(58) Field of Classification Search
CPC ..... D06F 39/02; D06F 39/022; D06F 33/37; D06F 33/57; D06F 34/08; D06F 2103/22; D06F 2105/58; D06F 2105/60
See application file for complete search history.

(56) References Cited

U.S. PATENT DOCUMENTS 4,524,805 A * 6/1985 Hoffman ..... F16K 15/147 137/846
5,082,150 A 1/1992 Steiner et al.
(Continued)

FOREIGN PATENT DOCUMENTS

CN 101652512 A 2/2010
CN 102108619 A 6/2011
(Continued)

OTHER PUBLICATIONS

International Search Report dated Jun. 23, 2015 in connection with International Application No. PCT/KR2015/002634, 5 pages.
(Continued)

*Primary Examiner* — David G Cormier

(57) ABSTRACT

In accordance with an embodiment of the present invention, a washing machine may be provided to be able to automatically add a liquid detergent into a tub. The washing machine in accordance with an embodiment of the present invention includes a detergent box for containing a detergent or rinse; a detergent supply pump for pumping the detergent or rinse contained in the detergent box; a connection pipe connected to the detergent supply pump and a tub; and an open/close unit for opening or closing the connection pipe, wherein the open/close unit is configured to open the connection pipe only when the detergent or rinse is pumped by the detergent supply pump.

17 Claims, 19 Drawing Sheets

(56) References Cited

U.S. PATENT DOCUMENTS

| | | | | |
|---|---|---|---|---|
| 8,739,578 | B2 | 6/2014 | Kim et al. | |
| 9,234,309 | B2 | 1/2016 | Lee et al. | |
| 2007/0084253 | A1* | 4/2007 | Ehrlich | A47L 15/4418 68/17 R |
| 2010/0115709 | A1* | 5/2010 | Kim | D06F 39/022 8/159 |
| 2010/0139328 | A1* | 6/2010 | Favaro | D06F 39/022 68/12.18 |
| 2012/0180533 | A1* | 7/2012 | Song | D06F 39/02 68/17 R |

FOREIGN PATENT DOCUMENTS

| | | | |
|---|---|---|---|
| EP | 0455431 | A1 | 11/1991 |
| EP | 2405052 | A1 | 1/2012 |
| EP | 2708633 | A1 | 3/2014 |
| FR | 2518137 | A1 | 6/1983 |
| KR | 10-0402446 | B1 | 10/2003 |
| KR | 20-0335455 | Y1 | 12/2003 |
| KR | 10-2008-0089087 | | 10/2008 |
| KR | 10-2011-0074239 | | 6/2011 |
| WO | 2012152057 | A1 | 11/2012 |

OTHER PUBLICATIONS

Extended European Search Report for European Application No. 15764270.3, dated Aug. 23, 2017. (14 pages).

Communication from a foreign patent office in a counterpart foreign application, Patent Office of the People's Republic of China, "Notification of Fulfilling of Registration Formality," Application No. CN 201580012531.5, dated Sep. 10, 2018, 5 pages.

Office Action dated Feb. 24, 2018 in connection with Chinese Patent Application No. 2015800125315.

Office Action dated Apr. 20, 2018 in connection with European Patent Application No. 15 764 270.3.

Communication pursuant to Article 94(3) EPC dated Mar. 14, 2019 in connection with European Patent Application No. 15 764 270.3, 4 pages.

* cited by examiner

[Fig. 1]
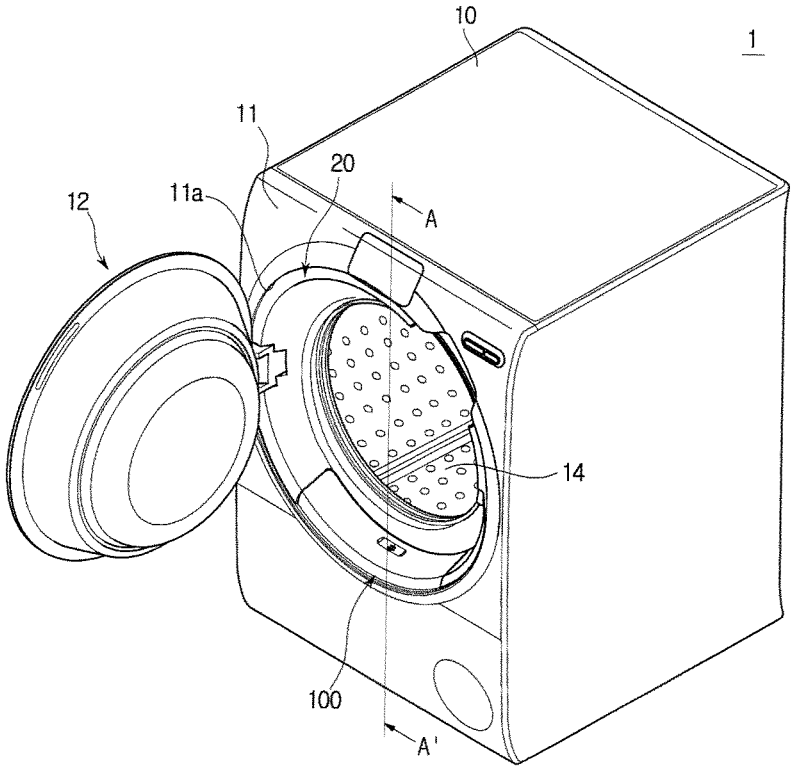
[Fig. 2]
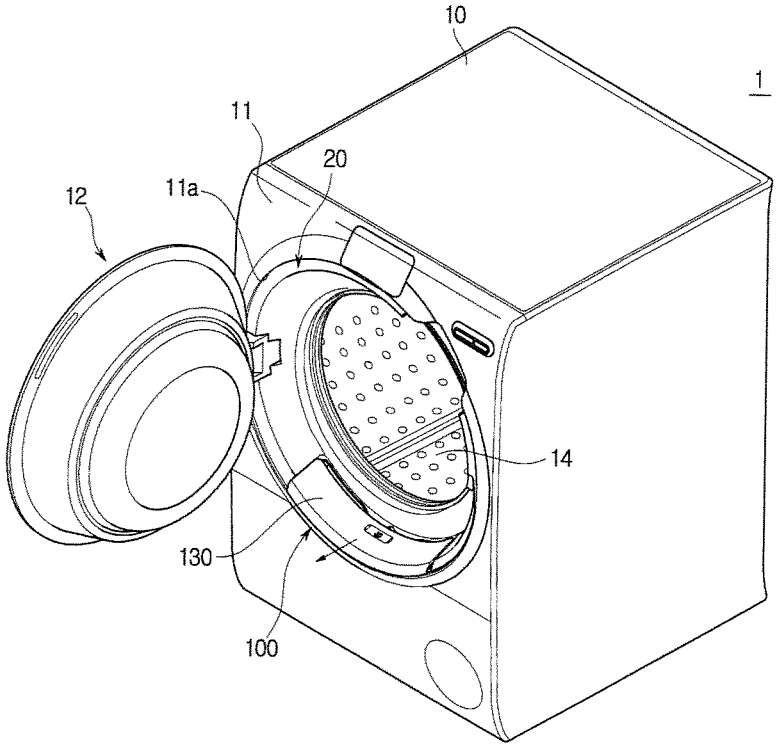

[Fig. 3]
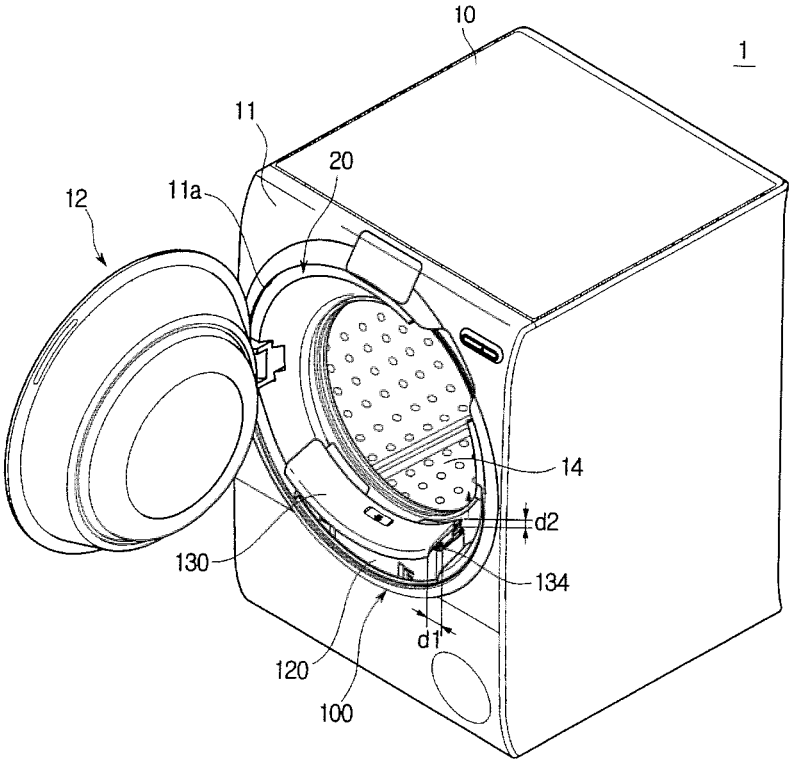

[Fig. 4]
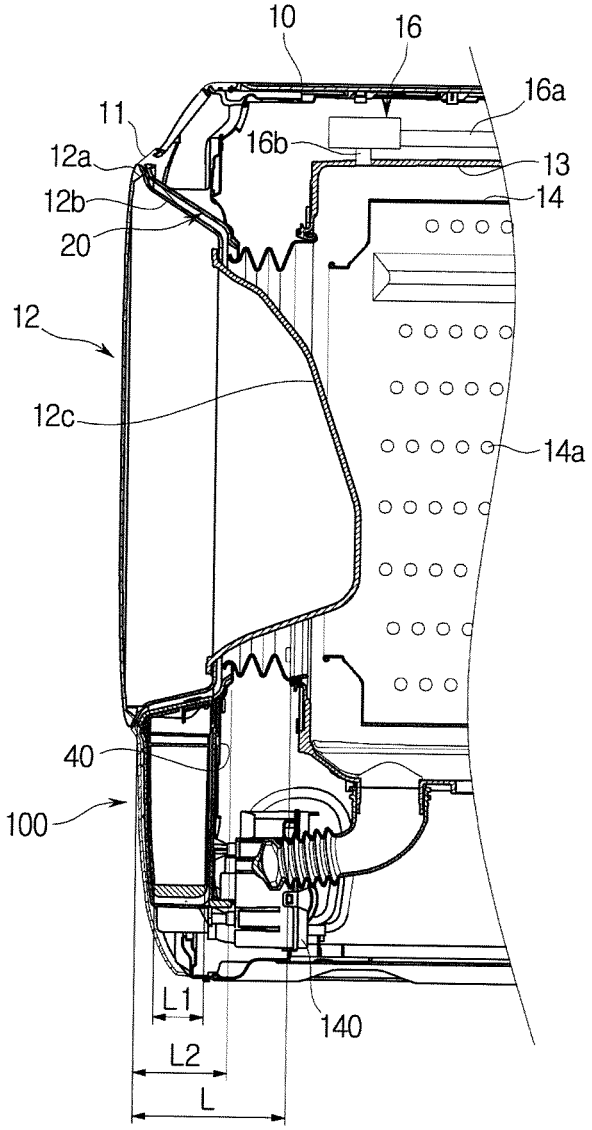

[Fig. 5]
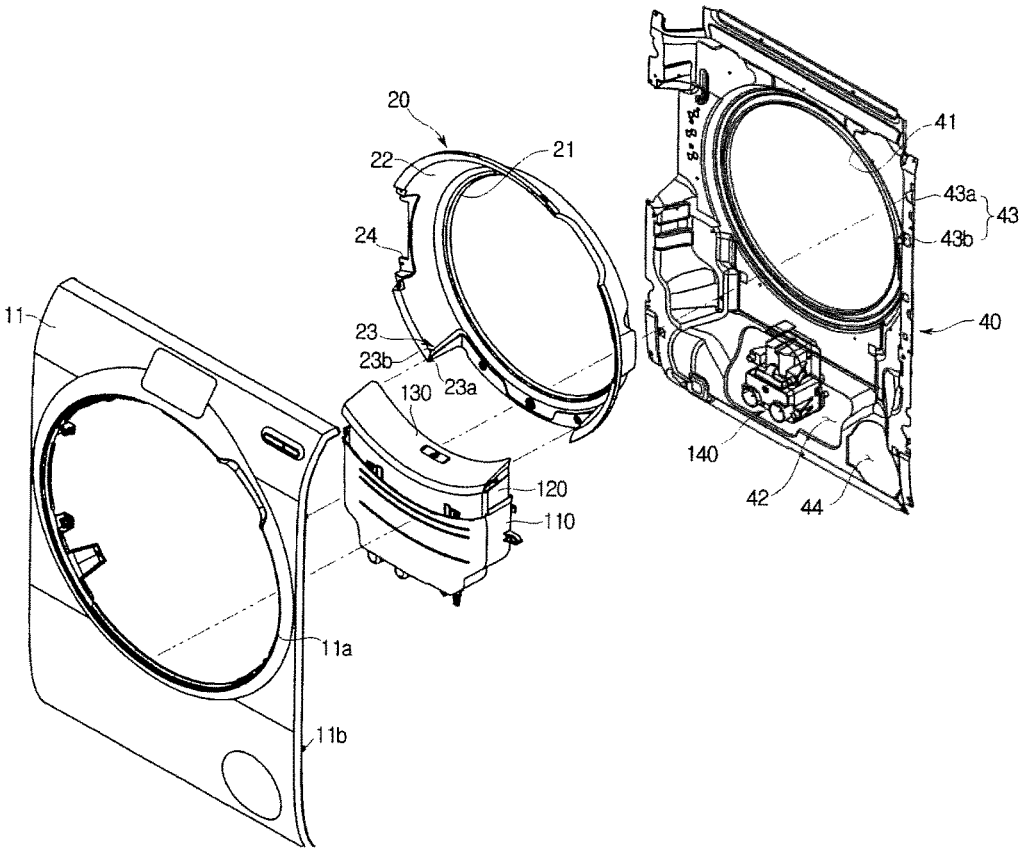

[Fig. 6]
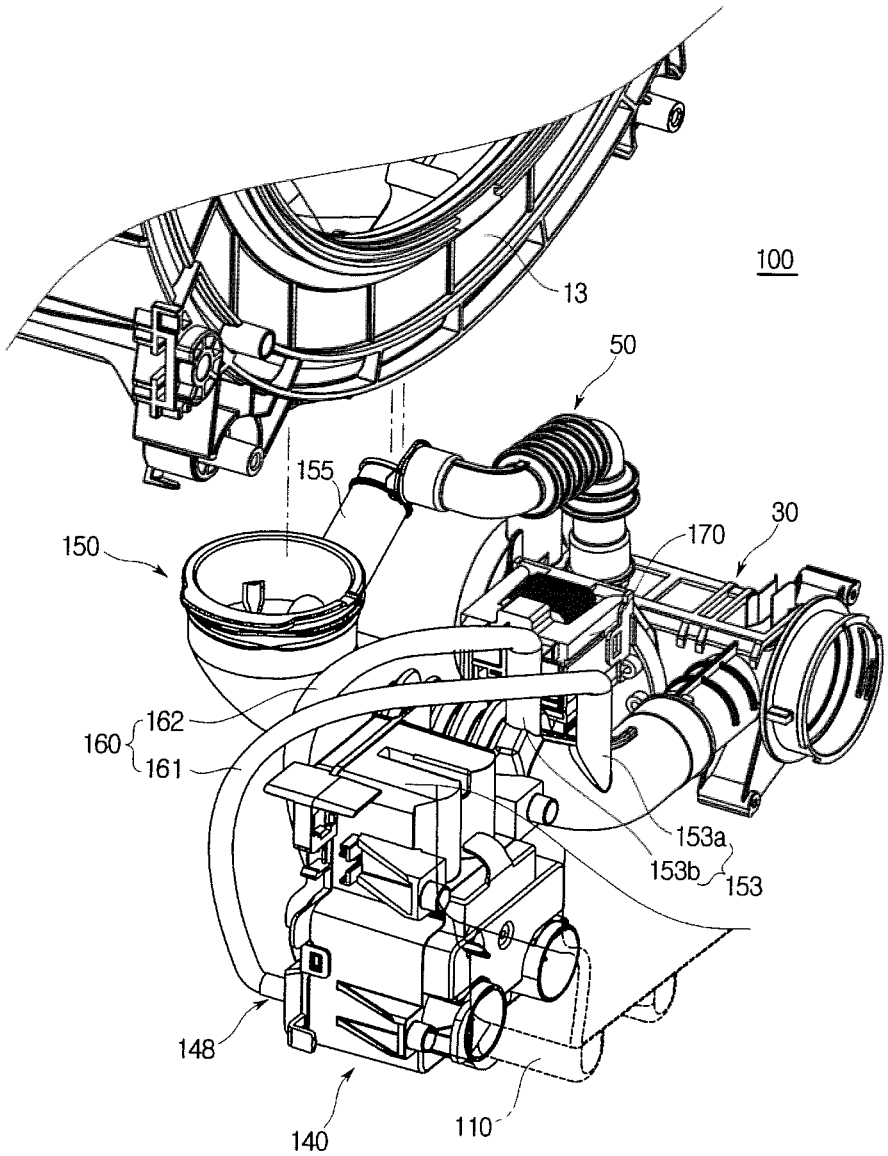

[Fig. 7]
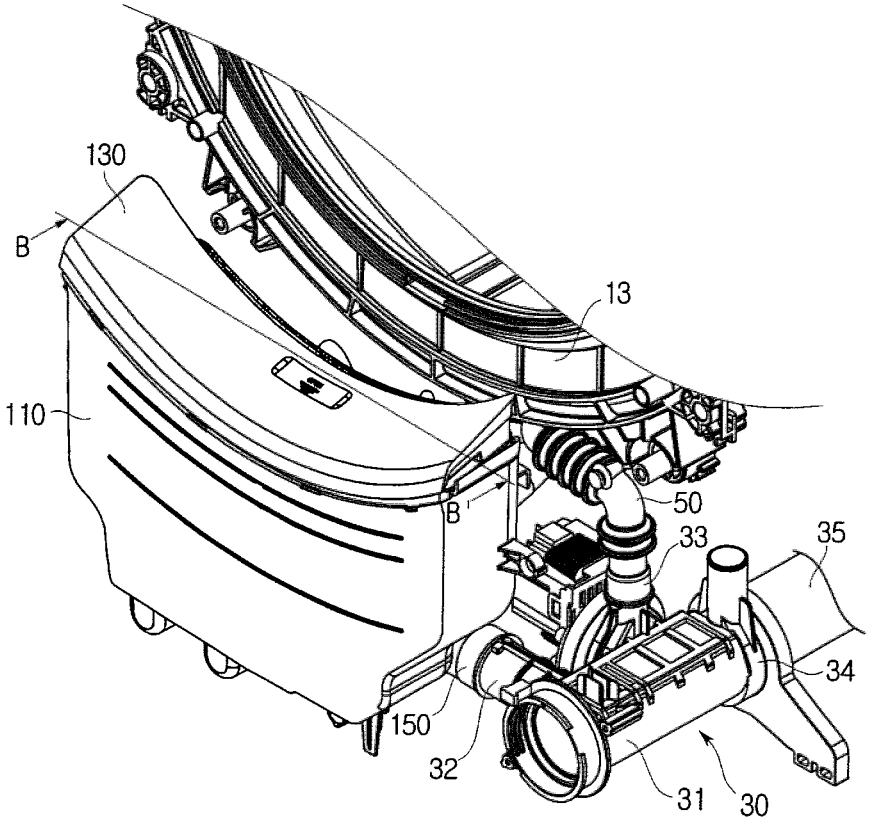

[Fig. 8]
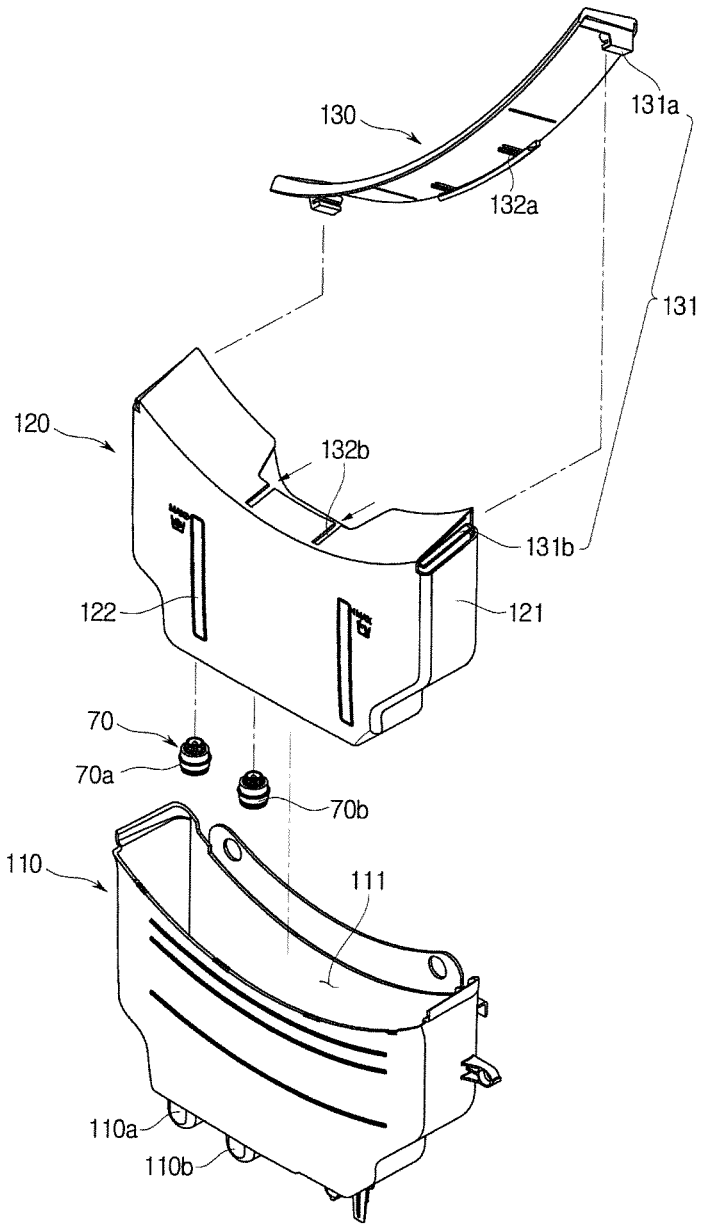

[Fig. 9]
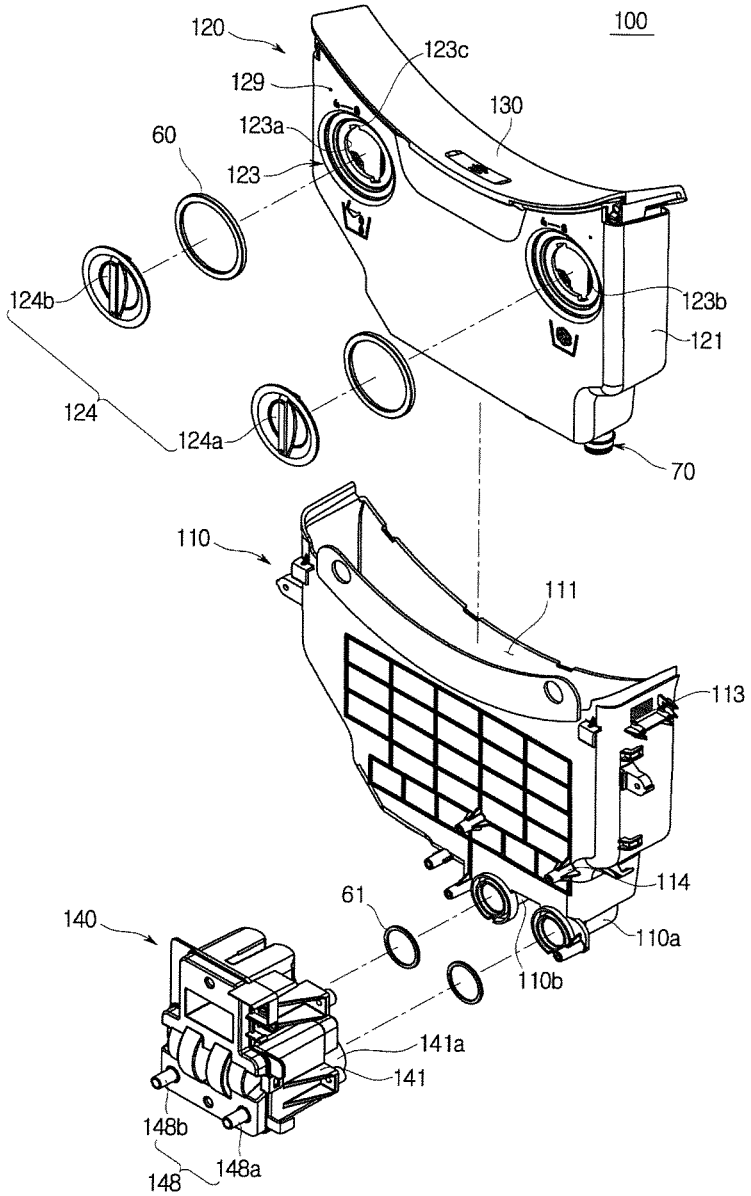

[Fig. 10]
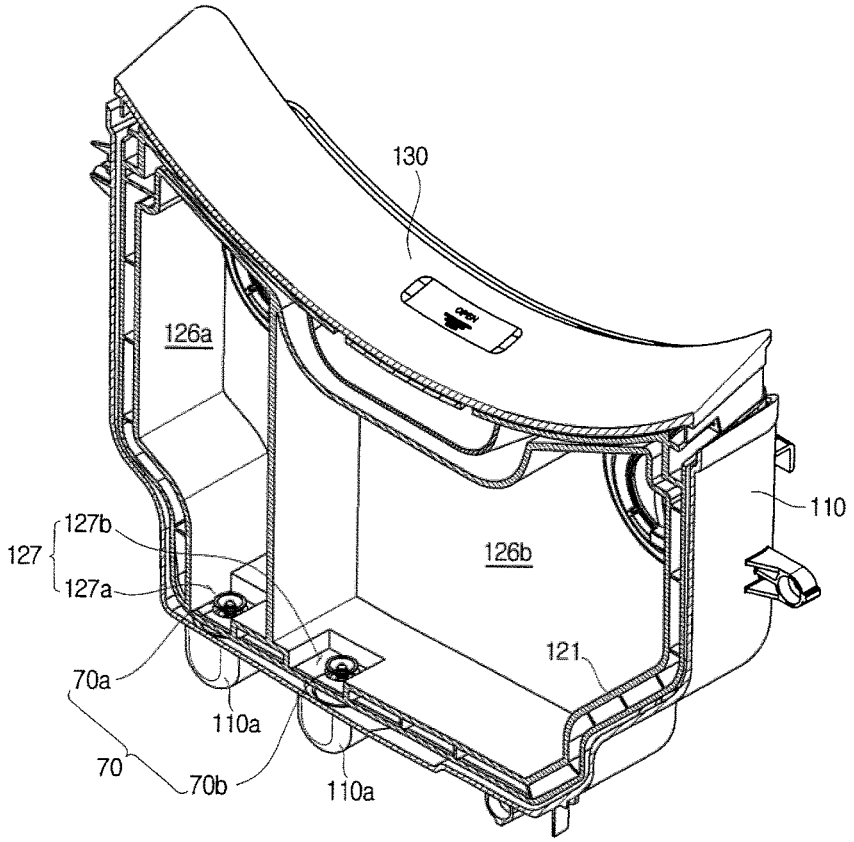
[Fig. 11]
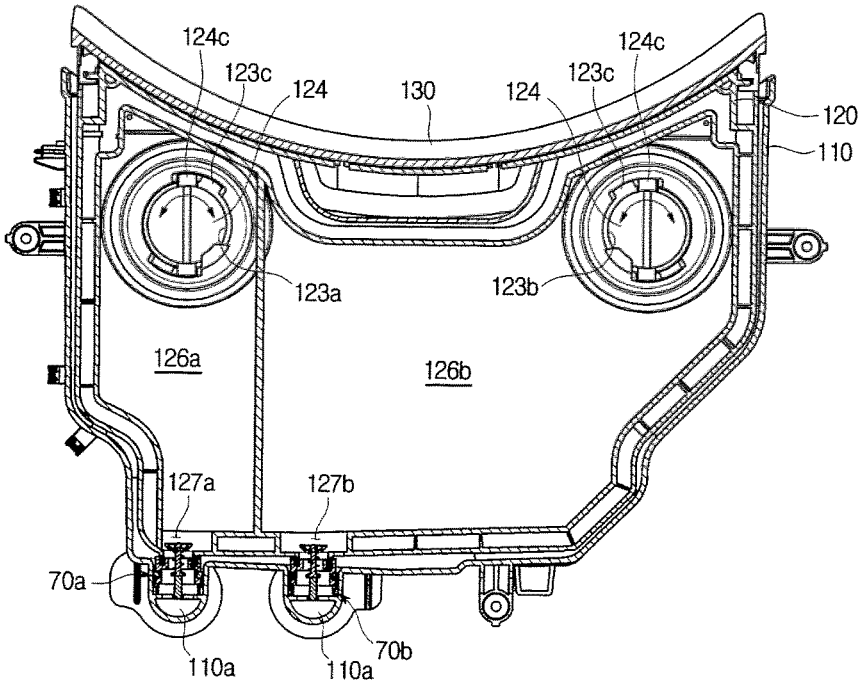

[Fig. 12]
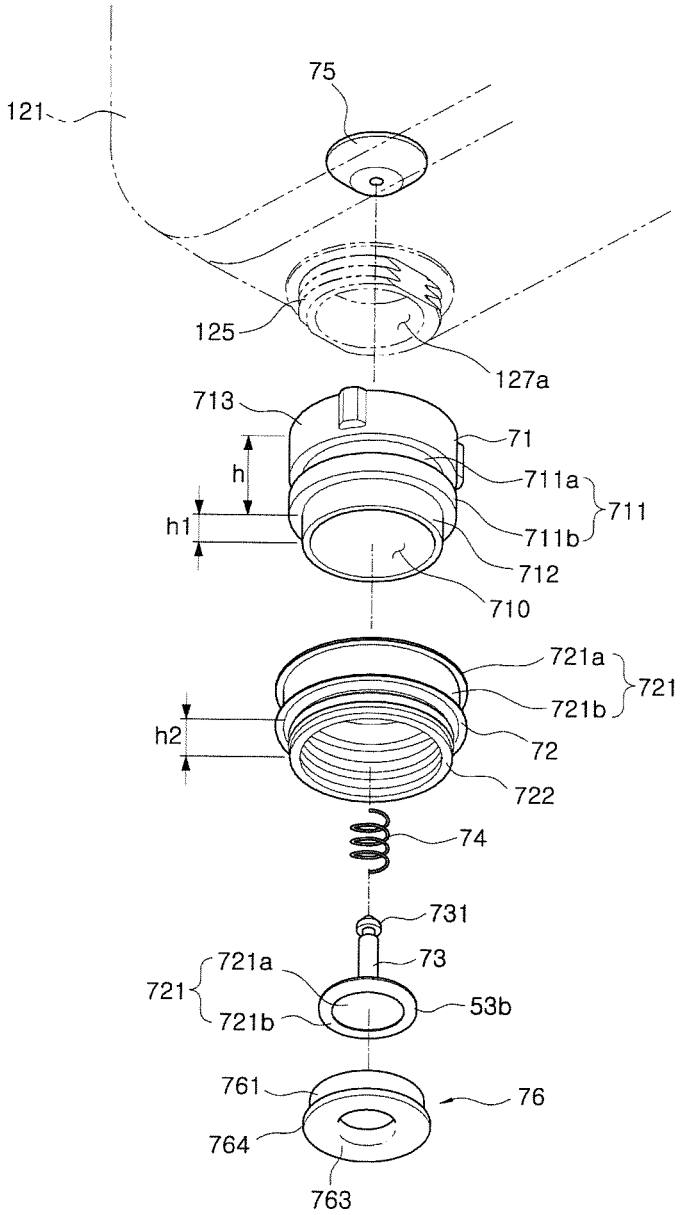

[Fig. 13]
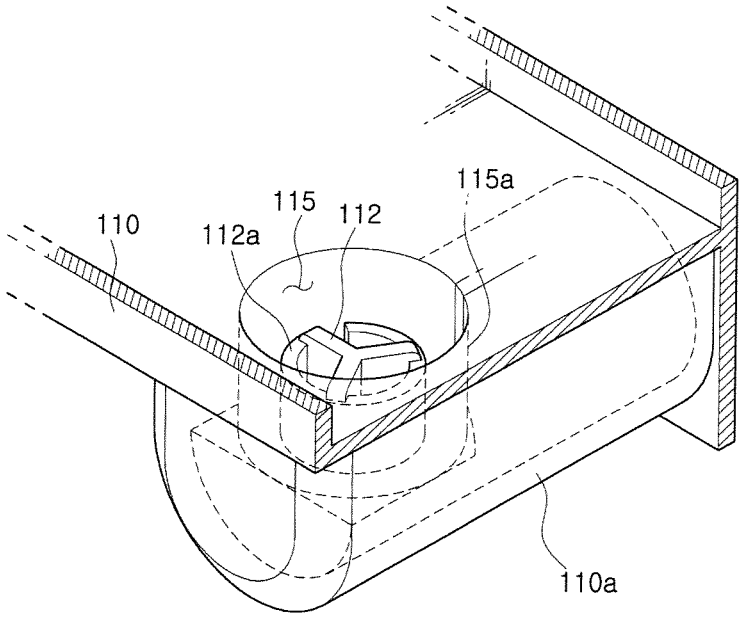
[Fig. 14]
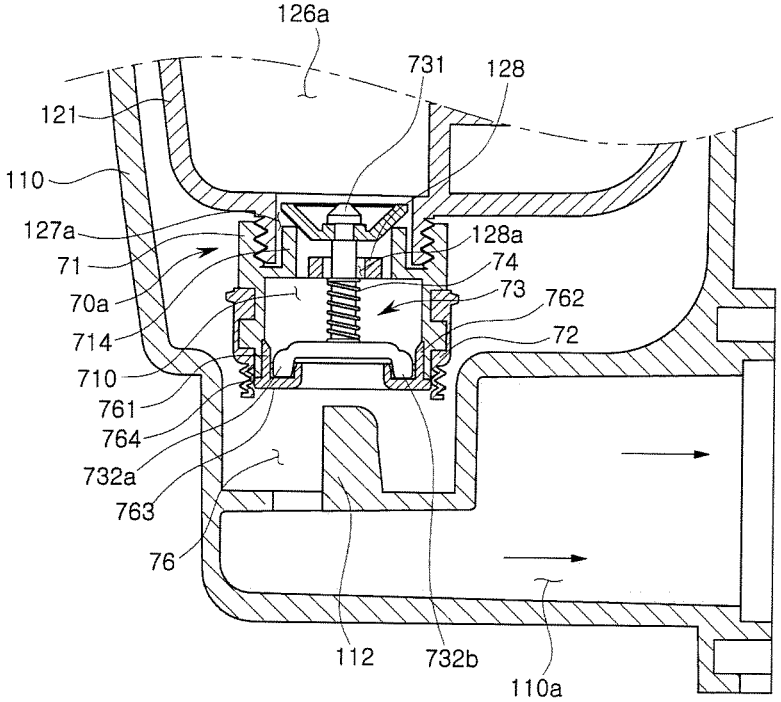

[Fig. 15]
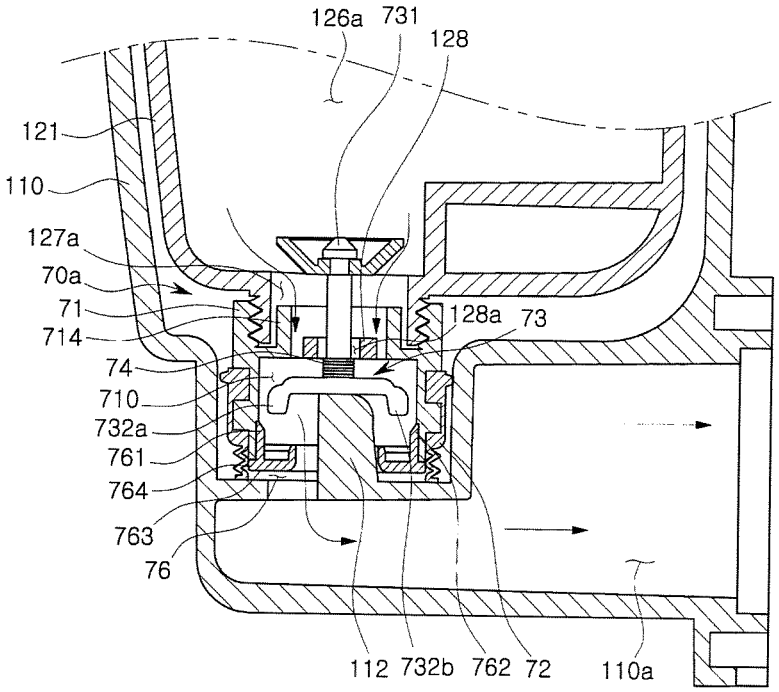
[Fig. 16]
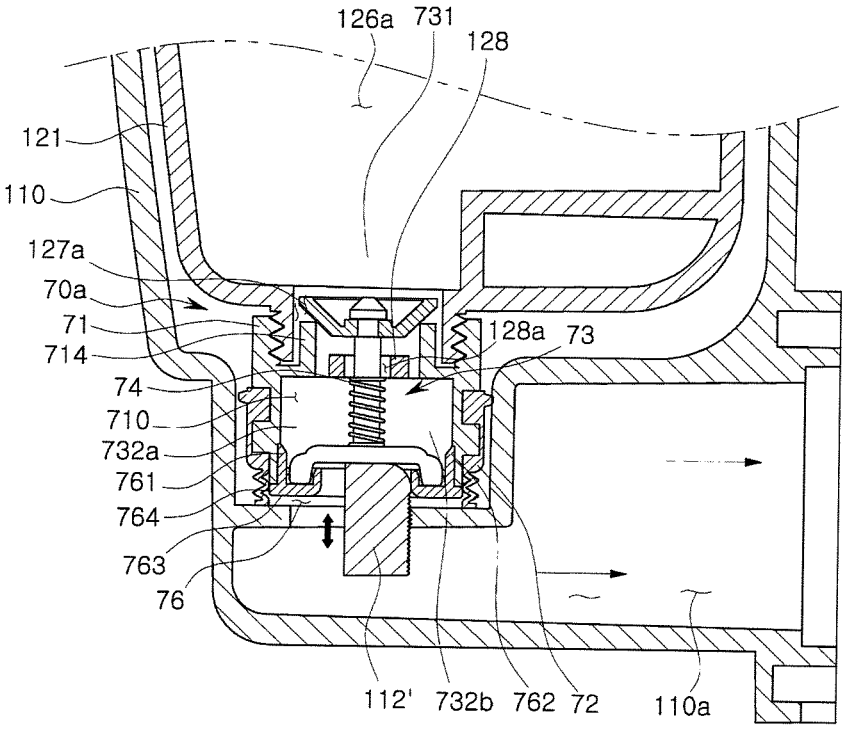

[Fig. 17]
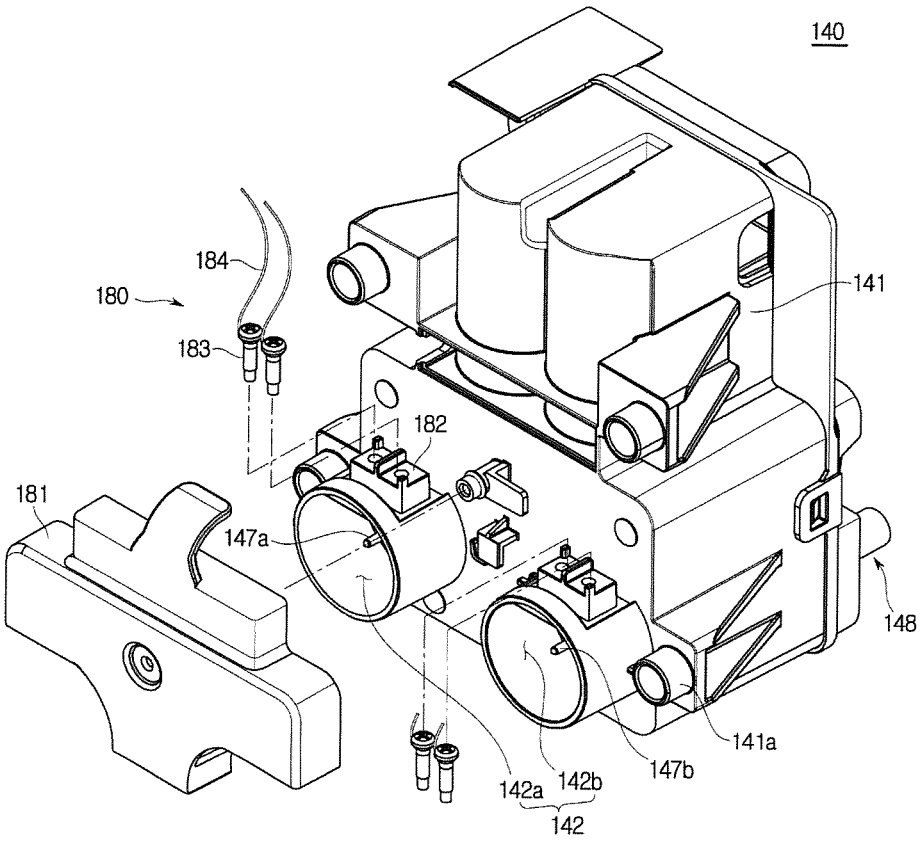

[Fig. 18]
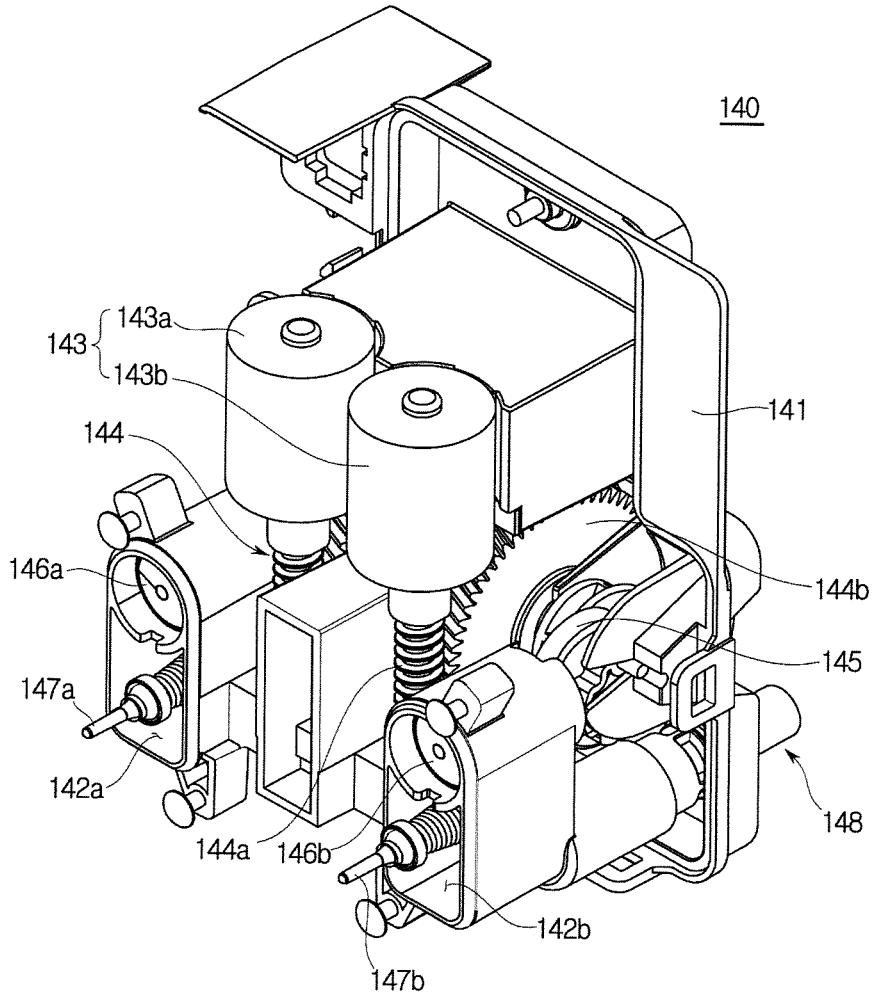

[Fig. 19]
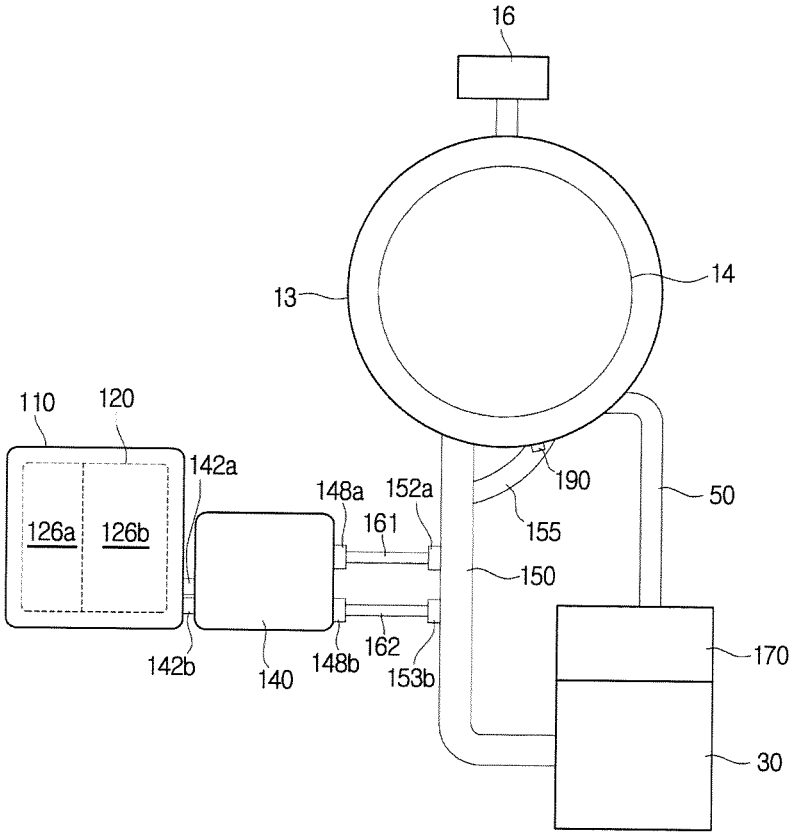

[Fig. 20]
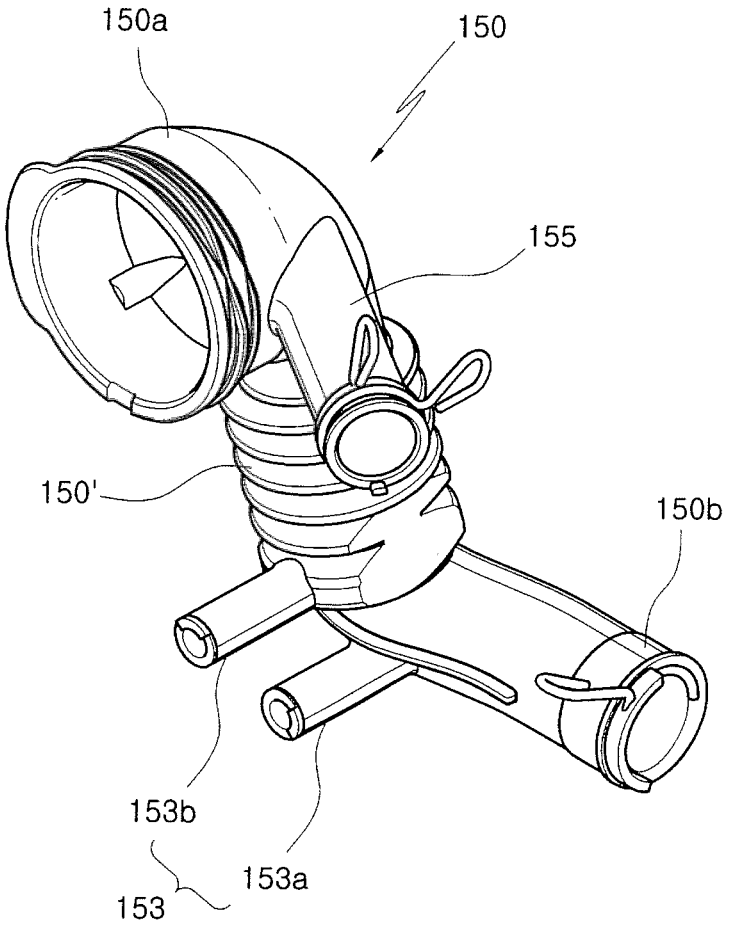

[Fig. 21]
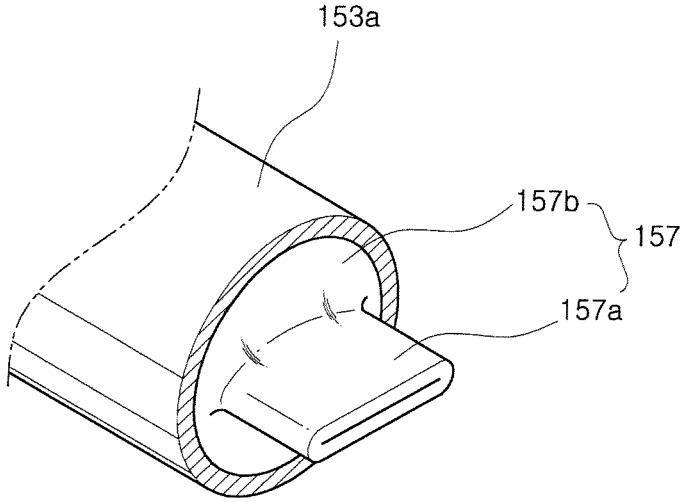
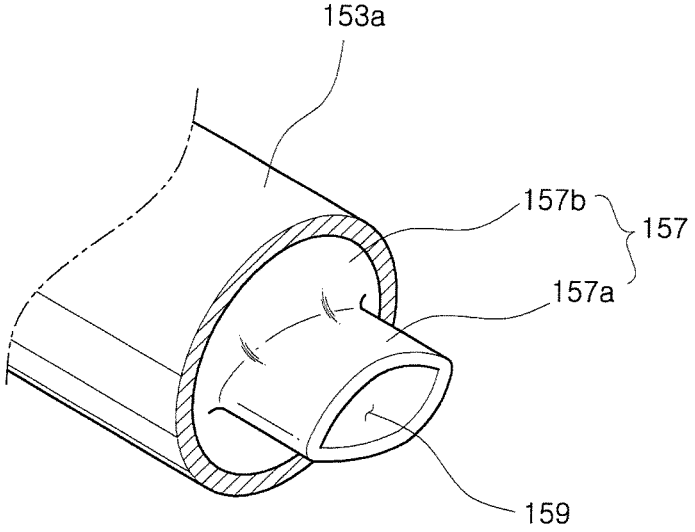

[Fig. 22]
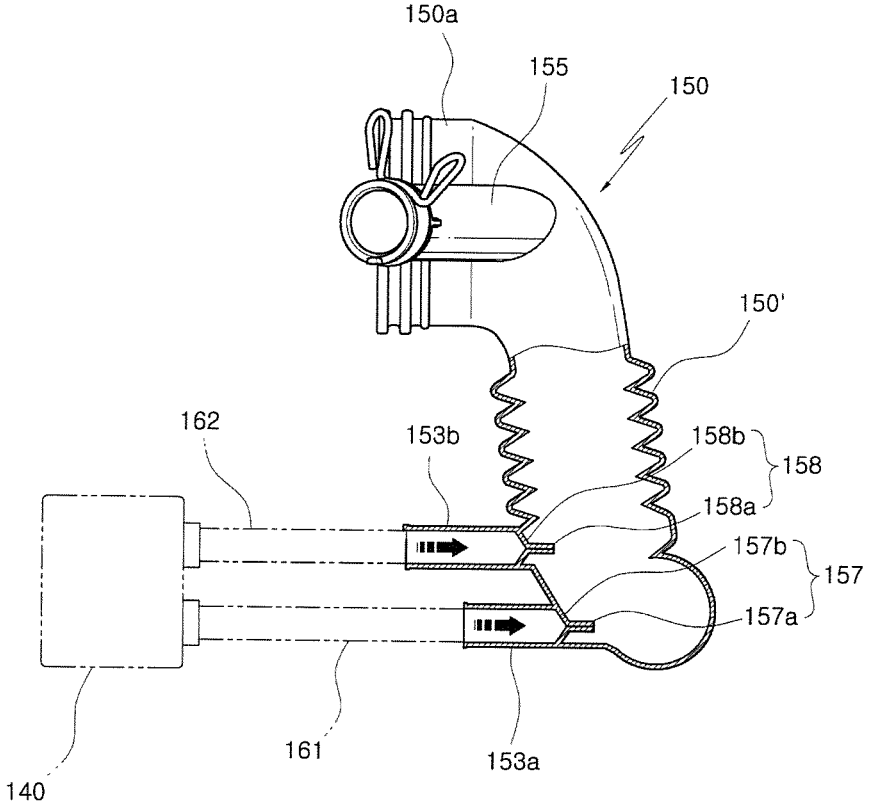
[Fig. 23]
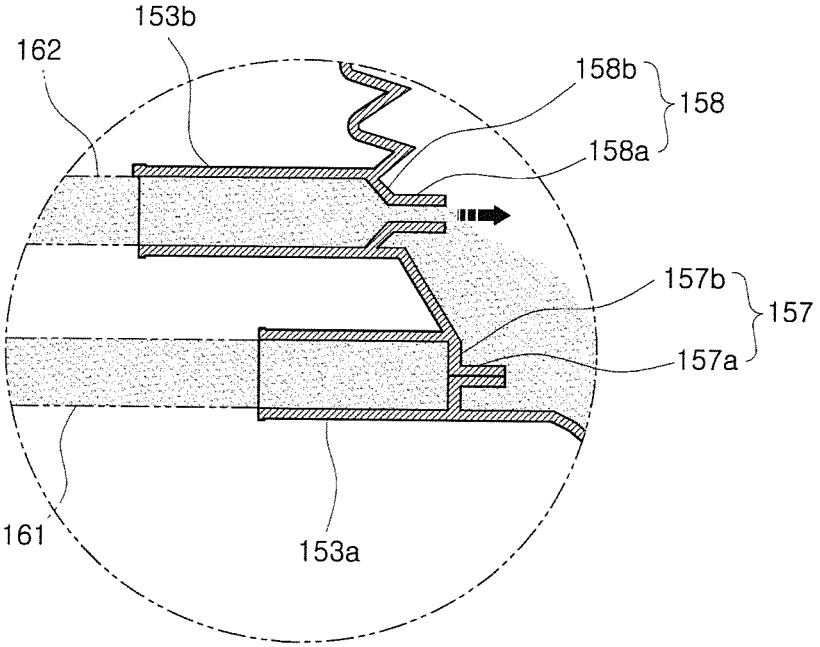

[Fig. 24]
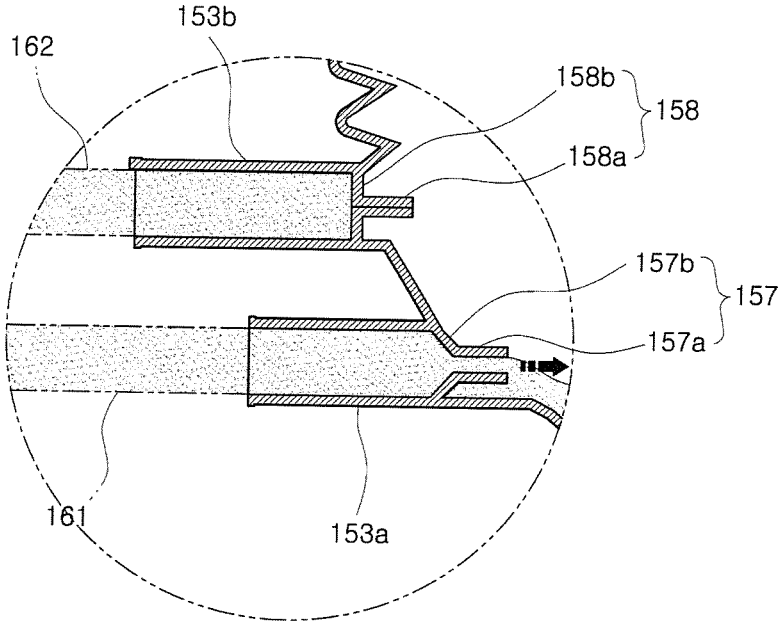
[Fig. 25]
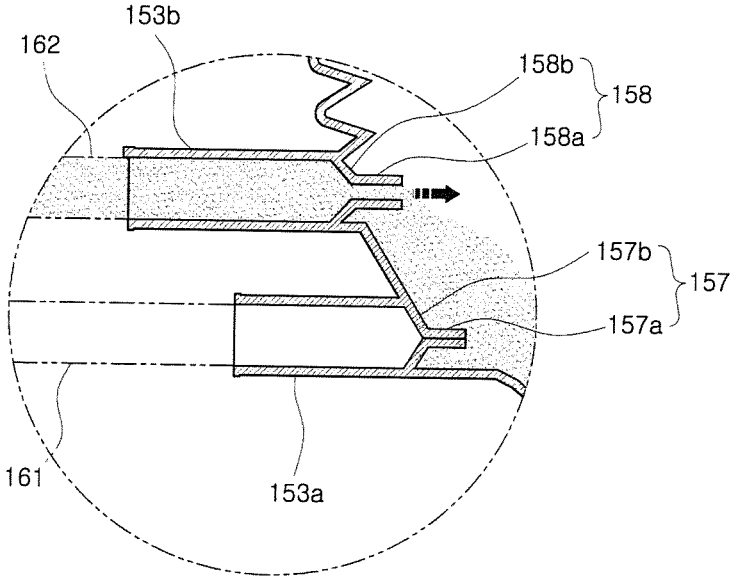

WASHING MACHINE

CROSS-REFERENCE TO RELATED APPLICATION(S)

The present application claims priority under 35 U.S.C. § 365 to International Patent Application No. PCT/KR2015/002634 filed Mar. 18, 2015, entitled "WASHING MACHINE", and, through International Patent Application No. PCT/KR2015/002634, to Korean Patent Application No. 10-2014-0033494 filed Mar. 21, 2014, Korean Patent Application No. 10-2014-0033572 filed Mar. 21, 2014 and Korean Patent Application No. 10-2014-0166185 filed Nov. 26, 2014, each of which are incorporated herein by reference into the present disclosure as if fully set forth herein.

TECHNICAL FIELD

The present invention relates to a washing machine that is able to automatically add liquid detergents.

BACKGROUND ART

Washing machines are devices for washing laundry by rotating its cylindrical rotating tub that contains the laundry and water. As for types of the washing machine, there are drum washers in which a rotating tub is horizontally located and laundry is washed by being raised and falling along the inner wall of the rotating tub while the rotating tub is rotated clockwise/counterclockwise around the horizontal axis, and vertical axis washers in which a rotating tub having a pulsator therein is vertically located and laundry is washed using water currents produced by the pulsator while the rotating tub is rotated clockwise/counterclockwise along the vertical axis.

The drum washer includes a housing that constitutes the exterior, a cylindrical water tub installed inside the housing for containing water, a rotating tub rotationally installed in the water tub for washing laundry, a driving motor arranged in the back of the water tube for turning the rotating tub, and a door installed on the front of the housing.

The drum washer is also equipped with a detergent supply unit for supplying a detergent to be uniformly mixed into water supplied in a process of supplying water into the water tube. The detergent supply unit is located in the lower part inside the main body. A detergent or rinse contained in the detergent supply unit may be moved into the tub by a detergent supply pump.

DISCLOSURE

Technical Problem

In accordance with an embodiment of the present invention, a washing machine may be provided to be able to automatically add a liquid detergent into a tub.

Also, a washing machine may be provided to prevent malfunction of an exhaust vale due to a foreign material between a detergent box for containing a liquid detergent and a case.

Furthermore, a washing machine may be provided to supply a liquid detergent or rinse into the tub only when the detergent supply pump is operating.

Furthermore, a washing machine may be provided to supply a liquid detergent or rinse into the tub only when the detergent supply pump is operating.

In addition, a washing machine may be provided to prevent leakage of the liquid detergent or rinse when the detergent box is pulled out.

Technical Solution

In an aspect of the present invention, a washing machine is provided. The washing machine includes a detergent box for containing a detergent or rinse; a detergent supply pump for pumping the detergent or rinse contained in the detergent box; a connection pipe connected to the detergent supply pump and a tub; and an open/close unit for opening or closing the connection pipe, wherein the open/close unit is configured to open the connection pipe only when the detergent or rinse is pumped by the detergent supply pump.

The open/close unit may be configured to block the connection pipe in order not to supply the detergent or rinse to the connection pipe when the detergent supply pump is not operating.

The open/close unit may be opened by a force of the detergent or rinse pumped by the detergent supply pump, which presses a side of the open/close unit.

The open/close unit may include a first blocking unit with an opening formed thereon, and a second blocking unit connected to the first blocking unit and fixed on an internal side of the connection pipe.

The opening may be closed as internal sides of the first blocking unit come in contact with each other, if the detergent supply pump is not operating.

The connection pipe may be blocked by the second blocking unit, if the detergent supply pump is not operating.

The opening of the first blocking unit may be opened if the detergent or rinse pumped by the detergent supply pump presses the second blocking unit.

The detergent or rinse pumped by the detergent supply pump may be supplied into the connection pipe if the opening of the first blocking unit is opened.

The opening may be opened as the second blocking unit is pushed by a pressing force of the detergent or rinse in a direction in which the detergent or rinse presses.

The second blocking unit may be returned to a position before it was pressed, and the opening may be closed, if operation of the detergent supply pump is stopped.

The connection pipe may include a main connection pipe connected to the tub, and a detergent connection tube branched from the main connection pipe and connected to the detergent supply pump.

The open/close unit may be equipped in the detergent connection tube.

The detergent connection tube may include a first detergent connection tube to which the detergent is pumped and supplied, and a second detergent connection tube to which the rinse is pumped and supplied.

The open/close unit may include a first open/close unit equipped in the first detergent connection tube and a second open/close unit equipped in the second detergent connection tube.

The first or second open/close unit may have the first or second detergent connection tube selectively piped with the main connection pipe.

The washing machine may further include a housing for detachably housing the detergent box.

An exhaust valve may be arranged in a detergent discharger of the detergent box.

The exhaust valve may include a valve case arranged in the detergent discharger to form an exhaust fluid path; and a plunger arranged to be able to move back and forth to shield the exhaust fluid path.

The housing may be equipped with a valve pressure unit that is able to press the plunger.

The valve pressure unit may be arranged to be able to rise and drop.

A sealing member may be equipped on a side of the plunger, and the detergent discharger may be opened or closed by the sealing member.

The plunger may be lowered and the detergent discharger may be shielded by the sealing member, as the detergent box received in the housing is raised.

The exhaust valve may include a supporter member to support the plunger when the plunger is lowered.

The bottom of the exhaust valve may be shielded when the plunger sits on the supporter member.

The valve pressure unit may press the plunger to open the exhaust fluid path, when the detergent box is received in the housing.

The washing machine may further include: an anti-leakage member arranged on the bottom of the exhaust valve for guiding the exhaust valve to be combined with a detergent inlet of the housing, thereby preventing leakage of a liquid detergent.

The exhaust valve may include a valve case arranged in the detergent discharger to form an exhaust fluid path; a plunger arranged to be able to move back and forth to shield the exhaust fluid path; and an elastic member arranged to elastically support the plunger.

The anti-leakage member may be formed on the bottom of the valve case.

The anti-leakage member may be integrally formed on the bottom of the valve case.

The anti-leakage member may include a ring or cylinder that extends downward from the valve case.

The housing may include a detergent inlet that corresponds to the detergent discharger, and the detergent inlet may be equipped with a valve combining groove formed for the valve case to be inserted thereto and a valve pressure unit formed to protrude to move up the plunger.

The valve pressure unit may have a ring-shaped supporter on the outer circumference.

A diameter of the anti-leakage member may be greater than that of the ring-shaped supporter and smaller than that of the valve combining groove.

In accordance with another aspect of the present invention, a washing machine is provided. A washing machine include a detergent box for containing a detergent or rinse; a housing for detachably receiving the detergent box; a detergent supply pump for pumping the detergent or rinse contained in the detergent box; a connection pipe connected to the detergent supply pump and a tub; and an exhaust valve for opening or closing a detergent discharger arranged in the detergent box and a detergent inlet arranged in the housing, wherein the exhaust valve includes a valve case arranged in the detergent discharger for forming an exhaust fluid path and a plunger for moving up and down in the valve case, and wherein the plunger blocks the bottom of the valve case when the detergent discharger is blocked.

The valve case may be equipped with a supporter member to support a back end of the plunger.

The bottom of the exhaust valve may be blocked when the back end of the plunger is supported by the supporter member.

A sealing member is equipped on a front end of the plunger to open or close the detergent discharger.

The housing may be equipped with a valve pressure unit that is able to press the plunger, and the detergent discharger and the detergent inlet may be piped when the plunger is pressed by the valve pressure unit.

The connection pipe may be equipped with an open/close unit that opens the connection when a liquid detergent or rinse is pumped by the detergent supply pump.

The open/close unit may be configured to block the connection pipe in order not to supply a liquid detergent or rinse to the connection pipe when the detergent supply pump is not operating.

Advantageous Effects

According to a washing machine in accordance with an embodiment of the present invention, leakage of a liquid detergent may be avoided by preventing malfunction of an exhaust valve.

Also, usability may be improved with an automatic detergent supply unit located in the lower part of the inside of the main body for containing a liquid detergent or rinse.

A set amount of liquid detergent or rinse may be supplied into the tub as the liquid detergent or rinse contained in the detergent box is supplied into the tub only when the detergent supply pump is operating.

Furthermore, an improved feature of an exhaust valve may prevent leakage of the liquid detergent or rinse from the valve case when the detergent box is pulled out.

DESCRIPTION OF DRAWINGS

FIG. 1 is a perspective view of a drum washer, according to an embodiment of the present invention;

FIGS. 2 and 3 are perspective views of a drum washer equipped with an automatic detergent supply unit, according to embodiments of the present disclosure;

FIG. 4 is a cross-sectional view along line A-A';

FIG. 5 shows a detergent box of an automatic detergent supply unit, which is installed on a detergent box installation unit, according to an embodiment of the present invention;

FIG. 6 shows an automatic detergent supply unit, according to an embodiment of the present invention;

FIG. 7 shows an automatic detergent supply unit and an exhaust unit, according to an embodiment of the present invention;

FIG. 8 is an exploded view showing a detergent box and a housing, according to an embodiment of the present invention;

FIG. 9 is an exploded view showing a detergent box of an automatic detergent supply unit, a housing, and a detergent supply pump, according to an embodiment of the present invention;

FIG. 10 shows an internal structure of a detergent box combined with a housing, according to an embodiment of the present invention;

FIG. 11 is a cross-sectional view along line B-B';

FIG. 12 is an exploded view showing an exhaust valve of a detergent box, according to an embodiment of the present invention;

FIG. 13 shows a detergent inlet of a housing, according to an embodiment of the present invention;

FIG. 14 is a cross-sectional view showing combination of an exhaust valve of a detergent box and a housing, according to an embodiment of the present invention;

FIG. 15 is a cross-sectional view showing an exhaust valve and a housing when the detergent box is pulled out, according to an embodiment of the present invention;

FIG. 16 is a cross-sectional view showing drop of a valve pressure unit, according to an embodiment of the present invention;

FIG. 17 shows a sensor unit installed in a detergent supply pump, according to an embodiment of the present invention;

FIG. 18 shows an internal structure of a detergent supply pump, according to an embodiment of the present invention;

FIG. 19 schematically shows operation of an automatic detergent supply unit, according to an embodiment of the present invention;

FIG. 20 is a perspective view of a first connection pipe, according to an embodiment of the present invention;

FIGS. 21 and 22 are perspective views of a part of a first detergent connection tube, according to an embodiment of the present invention;

FIG. 23 shows a first connection pipe, a part of which is cut open, according to an embodiment of the present invention;

FIG. 24 shows supply of a detergent into a first connection pipe, according to an embodiment of the present invention; and FIG. 25 shows supply of a rinse into a first connection pipe, according to an embodiment of the present invention.

BEST MODE

Embodiments of a washing machine in accordance with the present disclosure will now be described with reference to accompanying drawings.

FIG. 1 is a perspective view of a drum washer, according to an embodiment of the present invention, FIGS. 2 and 3 are perspective views of a drum washer equipped with an automatic detergent supply unit, according to embodiments of the present disclosure, FIG. 4 is a cross-sectional view along line A-A', and FIG. 5 shows a detergent box of an automatic detergent supply unit installed on a detergent box installation unit, according to an embodiment of the present invention.

As shown in FIGS. 1 to 5, a drum washer 1 includes a main body 10 that constitutes the exterior, a tub 13 installed inside the main body 10 for containing water, and a drum 14 rotationally installed inside the tub 13 and having a plurality of dehydrating holes formed on the wall of the drum 14.

On the front face 11 of the main body 10, an opening 11*a* is formed for laundry to be put into or pulled out of the tub 13 and the drum 14, and a door 12 is installed to open/close the opening 11*a* of the main body 10.

The door 12 may include door frames 12*a*, 12*b* arranged to constitute the exterior, and a door glass 12*c* combined on the back of the door frames 12*a*, 12*b* and inserted toward the inside of the main body 10.

The door frames 12*a*, 12*b* includes a first door frame 12*a* constituting the front face and a second door frame 12*b* constituting the back face.

The door glass 12*c* is combined on the center of the second door frame 12*b* for the inside of the drum 14 to be seen, thereby allowing the user to check an washing process with his/her eyes. The door glass 12*c* may be combined in a way that protrudes toward the back of the main body 10.

In the meantime, a door sitting member 20 is formed on the opening 11*a* of the main body 10 for the door 12 to safely sit on to close the opening 11*a*. The door sitting member 20 may be formed to correspond to the second door frame 12*b* that constitutes the back face of the door 12.

The door sitting member 20 has the form of a ring with a round opening 21 formed in the center, and may include a door sitting wall 22 formed for the rear part of the door 12 to contact and sit thereon and a detergent box installation unit 23 formed by incising at least a portion of the bottom part of the door sitting wall 22.

The door sitting wall 22 may be formed to be slanted backward from the front face 11 of the main body 10, i.e., toward the tub 13 and the drum 14. On a side of the door sitting wall 22, a hinge installation unit 24 is formed for the door 12 to be hinged with, and on the other side, a door latching unit (not shown) may be installed to open or close the door 12.

The detergent box installation unit 23 of the door sitting member 20 may include an opening 23*a* formed toward the front of the main body 10, and a detergent box sitting unit 23*b* formed to be stepped on the circumference of the back of the opening 23*a*. The detergent box sitting unit 23*b* may be formed to cave from the door sitting wall 22 to be combined with a detergent box cover 130 of an automatic detergent supply unit 100 as will be described later.

The door sitting member 20 is coplanar with the detergent box cover 130. That is, the top of the door sitting member 20 and the top of the detergent box cover 130 may be connected to each other without a gap, thereby improving aesthetic aspects. The detergent box cover 130 and the door sitting member 20 may be formed of the same material to enhance the appearance of the product.

In the meantime, the detergent box cover 130 is combined on the top of the detergent box 120 to be able to slide back and forth, and forms a forward movement gap d1 when moving forward from the main body 10. A backward movement gap d2 is formed to an extent that corresponds to the forward movement gap d1 between the detergent box cover 130 and the detergent box installation unit 23, in order for the user to attach or detach the detergent box 120 while holding the detergent box cover 130, using the forward and backward movement gaps d1 and d2 of the detergent box cover 130. In front of the main body 10, the user may use a projection 134 formed on the bottom of the detergent box cover 130 as a handle.

The user may move the detergent box cover 130 received in the detergent box sitting unit 23*b* of the detergent box installation unit 23 forward to form the forward and backward movement gaps d1, d2 on the top, and pull the detergent box 120 out of the main body 10 by using the projection 134 formed by being moved forward from the main body 10 as a handle. As such, the user may conveniently attach or detach the detergent box 120 to or from the main body 10.

The detergent box installation box 23 has a first gap L2 to form a room for the detergent box 120 of the automatic detergent supply unit 100 to be located, and preferably, the first gap L2 may be formed to be smaller than a second gap L between the front face 11 of the main body 10 and the front side of the tub 13 but greater than a gap L1 of the detergent box.

A front frame 40 having a front frame inlet 41 formed to put laundry into the drum 14 may be formed between the front face 11 of the main body 10 and the tub 13.

A combiner 43 including a plurality of holes 43*a* and slots 43*b* is formed on the rim of the front frame 40, and the front frame 40 may be combined with the main body 10 by the combiner using combining members like screws, bolts, pins, rivets, etc. At least one or more combining projections 11*b* may be formed on the rim of the back of the front face 11 of the main body 10, to be combined with the combiner 43 of the front frame 40.

On the bottom of the front frame 40, a pump installation hole 42 formed through incision of at least a part of the bottom to install the detergent supply pump 140, and an exhaust unit installation hole 44 formed through incision to install the exhaust unit 30 may be included. The exhaust unit installation hole 44 may be formed to be at a certain distance from the pump installation hole 43. The pump installation hole 42 and exhaust unit installation hole 44 of the front frame 40 may be formed to correspond to the detergent supply pump 140 and the exhaust unit 30, respectively.

A housing 110 is arranged in front of the front frame 40 through the pump installation hole 42 of the front frame 40, and the detergent supply pump 140 connected behind the housing 110 may be arranged in the back of the front frame 40. An exhaust case 31 (see FIG. 7) of the exhaust unit 30 (also see FIG. 7) is arranged in the exhaust unit installation hole 44 of the front frame 40 to be detachably combined with a filter member (not shown) placed therein.

As such, by locating the automatic detergent supply unit 100 that is able to contain and automatically supply a detergent or rinse on the detergent box installation unit 23 formed on the bottom front of the main body 10 and on the door sitting member 20, user convenience may be improved and usability of the upper space of the main body 10 may be enhanced.

In the back of the main body 10, a water supply unit 16 is mounted to supply water into the tub 13. The water supply unit 16 may include a first water supply tube 16*a* connected to an external water supply source (not shown) and a second water supply tube 16*b* connected to the tub 13. A water supply valve (not shown) may be installed in the first water supply tube 16*a* to control water supply.

Water to be supplied to the tub 13 through the water supply unit 16 is mixed with a detergent and a rinse supplied by the automatic detergent supply unit 100 in the tub 13 to wash or rinse the laundry.

FIG. 6 shows an automatic detergent supply unit, according to an embodiment of the present invention, FIG. 7 shows an automatic detergent supply unit and an exhaust unit, according to an embodiment of the present invention, FIG. 8 is an exploded view showing a detergent box and a housing, according to an embodiment of the present invention, FIG. 9 is an exploded view showing a detergent box of an automatic detergent supply unit, a housing, and a detergent supply pump, according to an embodiment of the present invention, FIG. 10 shows an internal structure of a detergent box combined with a housing, according to an embodiment of the present invention, and FIG. 11 is a cross-sectional view along line B-B'.

As shown in FIGS. 6 to 11, the automatic detergent supply unit 100 includes a housing 110 arranged in the bottom of the front of the main body 10, the detergent box 120 arranged to be attachable to or detachable from the housing 110 and to contain a detergent or a rinse, and the detergent supply pump 140 arranged to release the detergent and rinse out of the detergent box 120.

The housing 110 is arranged in the bottom part of the front face 11 of the main body 10 and installed below a location that corresponds to the detergent box sitting unit 23*b* of the door sitting member 20.

The detergent box 120 is arranged to be inserted and detachably combined to the housing 110, and the detergent box cover 130 is combined on the top to slide back and forth of the main body 10.

The detergent box cover 130 is located on the top of the detergent box 120, and has a matching size, texture, and color with the detergent box sitting unit 23*b* of the door sitting member 20 so as not to destroy the design of the product.

A slider 131 may be included in the detergent box cover 130 and detergent box 120. The detergent box cover 130 may slide back and forth with respect to the detergent box 120 by means of the slider 131. The slider 131 may include guide projections 131*a* formed at either ends of the detergent box cover 130, a stopping projection 132*a* formed to protrude downward in the middle of the bottom of the detergent box cover 130, guide rails 131*b* formed on either ends of the detergent box 120 to correspond to the guide projections 131*a* of the detergent box cover 130, and a stopping groove 132*b* formed to be long in the direction of width of the detergent box 120 in the middle of the top of the detergent box 120 in order for the stopping projection 132*a* to be inserted and slide.

The guide projections 131 of the detergent box cover 130 are inserted into the guide rails 131*b* for the detergent box cover 130 to slide back and forth with respect to the detergent box 120. The stopping groove 132*b* formed on the top of the detergent box 120 serves as a stopper to prevent the detergent box cover 130 from moving farther than the length of the stopping groove 132*b* when the stopping projection 132*a* of the detergent box cover 130 is inserted thereto.

As shown in FIGS. 6 and 7, the main body 10 includes the exhaust unit 30 to forcefully exhaust water out of the tub 13 and a circulation pump 170 arranged in the exhaust unit 30 to circulate the water of the tub 13. The tub 13 and the exhaust unit 30 are connected by the first connection pipe 150, and the tub 13 and the circulation pump 170 are connected by the second connection pipe 50.

The first connection pipe 150 has one end connected to the bottom of the tub 13 and the other end connected to the exhaust unit 30, and a branching tube 155 formed by being branched from the first connection pipe 150 may be connected to a pressure sensor 190 connected to the tub 13 for measuring an amount of the water in the tub 13 (see FIG. 19).

A detergent connection tube 153 may be connected to the first connection pipe 150. The detergent connection tube 153 may connect the first connection pipe 150 and the detergent supply pump 140. The detergent connection tube 153 may include a first detergent connection tube 153*a* and a second detergent connection tube 153*b*.

The exhaust unit 30 may include an exhaust pump (not shown) to release the water to the outside, a circulation pump 170 to circulate the water to the tub 13, and the filter member (not shown) placed to filter out foreign materials included in the water for laundry.

The exhaust unit 30 includes an exhaust case 31 formed for the exhaust pump and the circulation pump 170 to be connected to each other. The exhaust case 31 includes a first connection tube 32 connected to the first connection pipe 150, a second connection tube 33 connected to the second connection pipe 50, and a third connection tube 34 connected to the second connection tube and an exhaust hose 35. The exhaust hose 31 may be connected to the tub 13 through the first connection pipe 150 and the first connection tube 32 to be supplied with the water, may be connected to the circulation pump 170 through the second connection pipe 50 and the second connection tube 33 to enable the water to be circulated through the tub 13 and the exhaust hose 31, and may guide the water flowing into the exhaust case 31 through the third connection tube 34 and the exhaust hose 35 to flow out of the main body 10. The front side of the exhaust case 31 is open for an exhaust filter to be detachably mounted thereon.

A detergent supply tube 160 connected to the detergent supply pump 140 to supply the detergent and rinse is connected to the first and second detergent connection tubes 153*a* and 153*b* of the first connection pipe 150, to supply the detergent and rinse to the tub 13 from the detergent supply tube 160 through the circulation pump 170.

As shown in FIGS. 8 to 10, the detergent box 120 of the automatic detergent supply unit 100 includes a detergent box body 121 equipped with a first container 126*a* for containing a detergent and a second container 126*b* for containing a rinse.

On the front of the detergent box body 121, a detergent check window 122 is formed for the user to check remaining amounts of the detergent and rinse with his/her eyes. The detergent check window 122 may be formed of a fully transparent or opaque material, and may be insert-injection molded in an injection molding process.

The detergent box body 121 includes the detergent supply unit 123 arranged to supply the detergent and the rinse to the first and second containers 126*a* and 126*b*, respectively, and a detergent discharger 127 arranged to discharge the detergent and the rinse from the first and second containers 126*a* and 126*b*, respectively.

While the detergent and the rinse are illustrated to be contained in the first and second containers 126*a* and 126*b*, respectively, in the embodiment of the present invention, the present invention is not limited thereto.

The detergent supply unit 123 may be formed in the back of the detergent box body 121, and include the first detergent supply unit 123*a* for supplying the detergent to the first container 126*a* and the second detergent supply unit 123*b* for supplying the rinse to the second container 126*b*.

The first and second detergent supply units 123*a* and 123*b* may have a cap 124 formed to open or close the first and second detergent supply units 123*a* or 123*b*.

The cap 124 may include a first cap 124*a* to open or close the first detergent supply unit 123*a* and a second cap 124*b* to open or close the second detergent supply unit 123*b*. The caps 124*a*, 124*b* may be shaped to correspond to the first and second detergent supply units 123*a* and 123*b*. There may be a sealing member 60 formed between the detergent supply unit 123 and the cap 124 for sealing.

In the embodiment, the caps 124*a*, 124*b* include protruding projections 124*c*, and grooves 123*c* are formed in the first and second detergent supply units 123*a* and 123*b* to correspond to the projections 124*c* of the caps 124*a*, 124*b* such that the respective caps 124, 124*a*, 124*b* may be positioned on the first and second detergent supply units 123*a* and 123*b* and rotated until they are fixed by engagement of the projections 124*c* and the grooves 123*c*.

While the detergent supply unit 123 and the cap 124 have round shaped forms in the embodiment, the invention is not limited thereto and the detergent supply unit and the cap may be implemented in various forms.

The detergent discharger 127 is formed below each of the first and second containers 126*a* and 126*b*. The detergent discharger 127 may include a first detergent discharger 127*a* formed below the first container 126*a* and a second detergent discharger 127*b* formed below the second container 126*b*.

The first and second detergent dischargers 127*a* and 127*b* may be combined with the exhaust valve 70 to control discharging amounts of the detergent and the rinse between them and the housing 110. The exhaust valve 70 includes first and second exhaust valves 70*a* and 70*b*.

The first exhaust valve 70*a* may be combined with the first detergent discharger 127*a*, and the second exhaust valve 70*b* may be combined with the second detergent discharger 127*b*. The valves 70*a*, 70*b* may enable the detergent and rinse contained in the first and second containers 126*a* and 126*b*, respectively, to be discharged when they are opened while being combined with valve pressure units 112 of the housing 110, as will be described later. The exhaust valves 70*a*, 70*b* may be check valves.

Air ventilation holes 129 may be formed to perforate through the detergent box body 121 to suck external air in the first and second containers 126*a* ad 126*b*. The air ventilation holes 129 maintain the internal pressure of the detergent box body 121 to be constant, which results in internal pressures of the first and second containers 126*a* and 126*b* remaining constant, enabling the detergent and rinse to be smoothly discharged.

While the air ventilation holes 129 are illustrated to have a predetermined diameter in the embodiment of the present invention, the present invention is not limited thereto. For example, they include open/close members such as dampers.

The housing 110 has a detergent box body receiving unit 111 formed to have a detergent box body 121 inserted and received therein, and first and second reservoirs 110*a* and 110*b* piped to the first and second containers 126*a* and 126*b*, respectively, are formed in the bottom part of the body receiving unit 111.

The first and second reservoirs 110*a* and 110*b* of the housing 110 are connected to the first and second detergent dischargers 127*a* and 127*b* of the detergent box 120, respectively, to be supplied with the detergent or rinse from the first and second containers 126*a* and 126*b*.

Valve pressure units 112 (see FIG. 13) may be formed in the first and second reservoirs 110*a* and 110*b* such that the exhaust valves 70*a*, 70*b* combined with the first and second detergent dischargers 127*a* and 172*b* on the bottom of the detergent box body 121, respectively, are opened under pressure.

While the valve pressure units 112 are illustrated to have the form of projections that protrude upward to press and open the exhaust valves 70*a*, 70*b* in the embodiment, the present invention is not limited thereto.

An equipment detecting sensor 113 may be installed on the housing 110 to detect whether the detergent box 120 is combined with or separated from the housing 110. The equipment detecting sensor 113 including e.g., magnets may be installed on locations that correspond to a side of the housing 110 and a side of the detergent box body 121. With the equipment detection sensor 113, whether the detergent box 120 is combined with the housing 110 is detected, and the detection result may be displayed on a display unit 15.

In the lower back of the housing 110, a detergent supply pump combiner 114 may be formed to be combined with the detergent supply pump 140.

The detergent supply pump 40 is connected to the housing 110 and includes a pump housing 141 to constitute the external appearance. The detergent supply pump 140 is installed to be piped with the first and second reservoirs 110*a* and 110*b* in order to be supplied with the detergent and rinse from the housing 110. There may be a sealing member 61 between the housing 110 and the detergent supply pump 140 for sealing. In the detergent supply pump 140, a fixer 141*a* having a form that corresponds to the detergent supply pump combiner 114 of the housing 110 may be arranged. The pump housing 141 may include an exhaust outlet 148 for exhausting the detergent and rinse.

FIG. 12 is an exploded view showing an exhaust valve of a detergent box, according to an embodiment of the present invention.

Referring to FIG. 12, the detergent box body 121 in the embodiment includes a detergent discharger 127 to exhaust a liquid detergent or rinse contained in the detergent box 120. The detergent discharger 127 may include a first detergent discharger 127*a* equipped in the first container 126*a* for containing the liquid detergent and a second detergent discharger 127*b* equipped in the second container 126*b* for containing the rinse. The detergent discharger 127 may be equipped on the bottom of the detergent box body 121.

The detergent discharger 127 may include a first combiner 125 to be combined with the exhaust valve 70. The first combiner 125 may be formed to protrude downward to the detergent discharger 127 equipped on the bottom of the detergent box body 121. The first combiner 125 may be combined with the exhaust valve 70 that controls exhaust of the liquid detergent or rinse. A screw thread may be formed on the outer circumference of the first combiner 125.

A structure of the exhaust valve 70 to be combined with the first detergent discharger 127*a* formed in the first container 126 will now be described.

The exhaust valve 70 may include a valve case 71 combined with the first combiner 125. An exhaust fluid path 710 may be formed inside the valve case 71. The exhaust fluid path 710 may be formed to be piped with the detergent discharger 127*a*.

The valve case 71 may include a second combiner 713 with a screw thread corresponding to the screw thread formed on the outer circumference of the first combiner 125, formed on the inner side. The exhaust valve 70 may be combined when the second combiner 713 of the valve case 71 is rotated along the screw thread of the first combiner 125 formed in the detergent discharger 127*a*.

While the exhaust valve 70 is illustrated to be combined with the first combiner 125 formed in the detergent discharger 127*a* by a screw form in the embodiment of the present invention, the way of fastening the exhaust valve 70 to the detergent discharger 127*a* is not limited thereto. For example, the exhaust valve 70 may be fastened by being pressed into the detergent discharger 127*a* or through e.g., a hook structure.

A cap 72 with a cavity 720 may be combined in the lower part of the valve case 71. A first interlocker 711 may be included below the valve case 71, and a second interlocker 721 may be included above the cap 72. The cap 72 may be combined with the valve case 71 when the first interlocker 711 and the second interlocker 721 are combined together.

The first interlocker 711 includes a first interlocking groove 711*a* and a first interlocking projection 711*b*. The second interlocker 721 may include a first interlocking projection 721*a* and a second interlocking groove 721*b* formed on the cap 72. The first interlocking groove 711*a* and first interlocking projection 721*a* may be formed to correspond to each other, and the second interlocking groove 711*b* and second interlocking projection 721*b* may be formed to correspond to each other.

The cap 72 may be formed of a rubber material. A sealing unit 722 for sealing of the exhaust valve 70 may be included in the lower part of the cap 72.

A supporter plate 127 (see FIG. 14) is arranged inside the valve case 71, in which an installation hole 128*a* (see FIG. 14) is formed such that a plunger 73 passes through the installation hole 128*a* to be able to move back and forth. At an upper end of the valve case 71, a sheet unit 714 (see FIG. 14) is formed to contact the plunger 73 to shield the exhaust fluid path 710 through the back-and-forth movement of the plunger 73 is formed.

The plunger 73 may be arranged to be able to move back and forth in the exhaust fluid path 710 formed inside the valve case 71. The plunger 73 includes a front end 731 formed at the upper end and a back end 732 formed at the lower end.

The sealing member 75 may be combined at the front end 731 of the plunger 73, the sealing member 75 being in a hook form to contact the sheet unit 714 of the valve case 71 to shield the first detergent discharger 127*a* or the exhaust fluid path 710. The sealing member 75 may be formed to be equal to or greater than a cross-sectional area of the exhaust fluid path 710 or the first detergent discharger 127*a*.

The back end 732 of the plunger 73 may include a first back end 732*a* combined with the plunger body 73*a* and a second back end 732*b* bending and extending from the first back end 732*a*. The second back end 732*b* may extend from an ending part of the first back end 732*a* in the direction opposite to the plunger body 73*a*. The first and second back ends 732*a* and 732*b* may be formed into one body.

An elastic member 74 to elastically support the plunger 73 may be arranged between the back end 732 of the plunger 73 and the supporter plate 128 of the valve case 71. The elastic member 74 is formed to produce elastic power between the bottom of the supporter plate 128 and the back end 732 of the plunger 73. The elastic member 74 enables the first detergent discharger 127 to be shielded by the sealing member 75 as long as there is no external force produced by pushing down the plunger 73.

A supporter member 76 for supporting the back end 732 of the plunger 73 may be included below the cap 72. An equipment hole (not shown) is included on the side of the cap 72, and the supporter member 76 may be equipped in the cap 72 when an equipment projection 764 formed on one side of the supporter member 76 is inserted into the equipment hole. The way to have the supporter member 76 equipped in the cap 72 is not limited thereto.

The supporter member 76 may include a receiving unit 760 that receives a part of the back end 732. The receiving unit 760 may be constituted with a first side wall 761, a second side wall 762, and a supporter 763 that connects the first and second side walls 761 and 762. The first back end 732*b* may be received in the receiving unit 760. A second back end 762*b* received in the receiving unit 760 may be supported by the supporter 763.

The outer side of the first side wall 761 may be formed to correspond to the lower inside of the cap 72. An equipment projection 764 may be on the outer side of the first side wall 761 and may be inserted into an equipment hole 723 formed in the cap 72.

FIG. 13 shows a detergent inlet of a housing, according to an embodiment of the present invention.

Referring to FIG. 13, a detergent inlet 115 is formed in the housing 110 in accordance with the embodiment of the present invention to have a form that corresponds to the detergent discharger 127*a*. The detergent inlet 115 may include a valve combining groove 115*a* formed to cave for the lower part of the valve case 71 of the exhaust valve 70 to be inserted thereto, and a valve pressure unit 112 included inside the valve combining groove 115*a*.

The exhaust valve 70 may be opened by the valve pressure unit 112. The valve pressure unit 112 may be formed to protrude upward such that it may press and move the plunger 73 upward.

A ring-shaped supporter 112*a* may be formed around the outer circumference of the valve pressure unit 112. The ring-shaped supporter 112*a* may help prevent foreign materials flowing into the housing from flowing toward the detergent inlet 115. Furthermore, if a foreign material flows into the detergent inlet 115, it may force the detergent box 120 to be apart from the housing 110 and accordingly, the detergent box 120 may not be fully inserted into the housing 110. The user may check whether the detergent box 120 is inserted or not with his/her eyes. Accordingly, it may help prevent malfunction of the exhaust valve 70 due to foreign materials such as a bolt.

The housing 110 includes a detergent box body reception unit 111 formed to receive the detergent box body 121. In the lower part of the detergent box body reception unit 111, first and second reservoirs 110*a* and 110*b* may be formed to be piped with first and second containers 126*a* and 126*b* of the detergent box 120. The detergent or rinse supplied from the first or second container 126*a* or 126*b* of the detergent box 120 may be delivered to the detergent supply pump 140 through the first and second reservoirs 110 and 110*b*.

FIG. 14 is a cross-sectional view showing combination of an exhaust valve of a detergent box and a housing, according to an embodiment of the present invention, and FIG. 15 is a cross-sectional view showing the exhaust valve and the housing when the detergent box is pulled out, according to an embodiment of the present invention.

Referring to FIGS. 14 and 15, the exhaust valve 70 of the detergent box 120 in the embodiment of the present invention may be opened. When the detergent box 120 is received in the detergent box body reception unit 111, the plunger 73 may rise by being pressed by the valve pressure unit 112. The sealing member 75 may rise with the plunger 73, to open the first detergent discharger 127*a*. When the sealing member 75 opens the first detergent discharger 127*a*, the detergent or rinse contained in the first container 126*a* may be exhausted through the first discharger 127*a* and pass through the exhaust fluid path 710 inside the exhaust valve 70 into the first reservoir 110*a*.

In this case, the back end 732 of the plunger 73 may be separated apart from the supporter 763 of the supporter member 76. When the exhaust valve 70 is opened, the back end 732 of the plunger 73 is not received in the receiving unit 760 placed in the supporting member 76.

The user may pull the detergent box 120 out of the housing 110 to add a liquid detergent or rinse. When the detergent box 120 is moved upward by the user, the first detergent discharger 126*a* may be shielded by the sealing member 75 located above the plunger 73. The plunger 73 remains under pressure of the valve pressure unit 112 until the first detergent discharger 126*a* is shielded by the sealing member 75 as the detergent box 120 moves up.

If the detergent box 120 moves further up since the first detergent discharger 126*a* has been shielded by the sealing member 75, the plunger 73 may be moved upward with the detergent box 120 while the first detergent discharger 126*a* is shielded by the sealing member 75. As the plunger 73 is moved up, the plunger 73 may be released from the pressure of the valve pressure unit 112.

When the sealing member 75 shields the first detergent discharger 126*a*, the back end 732 of the plunger 73 may safely sit on the supporter 763 of the supporter member 76. The back end 732 of the plunger 73 may be moved up with the detergent box 120 while being supported by the supporter 763. The bottom part of the exhaust valve 70 may be shielded when the back end 732 of the plunger 73 safely sits on the supporter member 76. This avoids the remaining liquid detergent or rinse left inside the exhaust valve 70 flowing outside.

Even if the detergent box 120 is moved up and separated from the housing 110, the first detergent discharger 126*a* is shielded by the sealing member 75 and thus, the liquid detergent or rinse contained in the first container 126*a* may not be exhausted to the outside. Even if the first detergent discharger 126*a* is shielded by the sealing member 75, the liquid detergent or rinse may be left inside the exhaust valve 70.

In the past, there was no existing structure to shield the inside of the exhaust valve, and thus, when the plunger 73 and the valve pressure unit become distant from each other as the detergent box 120 is moved up, the liquid detergent or rinse contained in the exhaust valve may flow out, possibly making a mess around the detergent box 120 or splashing the liquid detergent or rinse over the user.

In the present invention, a structure to shield the bottom of the exhaust valve 70 is provided to prevent the liquid detergent or rinse left inside the exhaust valve 70 from flowing outside when the detergent box 120 is separated from the housing 110.

FIG. 16 is a cross-sectional view showing drop of a valve pressure unit, according to an embodiment of the present invention.

Referring to FIG. 16, the valve pressure unit 112 of the present invention may be formed to be able to rise and drop. The user may manipulate a switch (not shown) connected to the valve pressure unit 112 to elevate or lower the valve pressure unit 112.

When the detergent box 120 is received in the housing 110, the plunger 74 may be pressed by the valve pressure unit 112 and the first detergent discharger 127*a* may be opened. With the open first detergent discharger 127*a*, the liquid or rinse contained in the first container 126*a* may be moved toward the first reservoir 110*a* through the exhaust fluid path 710, which is an inside room of the exhaust valve 70.

The user may take the detergent box 120 apart from the housing 110 to add a liquid detergent or rinse. Before pulling the detergent box 120 out of the housing 110, the user may manipulate the switch connected to the valve pressure unit 112 to lower the valve pressure unit 112.

As the valve pressure unit 112 is lowered, the plunger 73 that has been pressed by the valve pressure unit 112 before drop may be lowered as well. The plunger 73 may be lowered with the valve pressure unit 112 by an elastic force from the elastic member 74. As the plunger 73 is lowered, the first detergent discharger 127*a* may be shielded by the sealing member 75.

Furthermore, when the plunger 73 is lowered, the back end 732 of the plunger 73 may safely sit on the supporter member 76 and the bottom part of the exhaust fluid path 710 may be shielded. When the bottom part of the exhaust fluid path 710 is shielded, the liquid detergent or rinse left inside the exhaust valve 70 may not flow outside even if the detergent box 120 is moved up and be separated from the housing 110.

As such, before the detergent box 120 is separated from the housing 110, lowering the valve pressure unit 112 for the back end 732 of the plunger 73 to shield the bottom part of the exhaust fluid path 71 may prevent the liquid detergent or rinse left inside the exhaust valve 70 from flowing outside when the detergent box 120 is separated. This allows separation of the detergent box 120 from the housing 110 without concern of the liquid detergent or rinse messing the surroundings or splashing over the user.

While the exhaust valve 70 and the valve pressure unit 112 to open/close the first detergent discharger 127*a* formed on the side of the first container 126*a* have been described above, the description may be similarly applied to an exhaust valve and valve pressure unit to open and close the second detergent discharger 127*a* formed on the side of the second container 126*a*.

FIG. 17 shows a sensor unit installed on a detergent supply pump, according to an embodiment of the present invention, and FIG. 18 shows an internal structure of the detergent supply pump, according to an embodiment of the present invention.

Referring to FIGS. 17 and 18, the detergent supply pump 140 may include a pump housing 141 connected to the housing 110 and arranged to constitute the exterior, a chamber 142 formed inside the pump housing 141 and connected to the first and second reservoirs 110*a* and 110*b*, a piston member 146 arranged to apply a pressure on the inside of the chamber 142, a motor 143 arranged to drive the piston member 146, and a gear member 144 for linking the motor 143 and the piston member 146.

The chamber 142 includes a first chamber 142*a* connected to the first reservoir 110*a*, and a second chamber 142*b* connected to the second reservoir 110*b*. The first chamber 142*a* may be supplied with a liquid detergent stored in the first reservoir 11*a*, and the second chamber 142*b* may be supplied with a rinse stored in the second reservoir 110*b*.

A sensor unit 180 for measuring whether there is a detergent and rinse to be supplied to the first and second chambers 142*a* and 142*b* may be installed in the pump housing 141. The sensor unit 180 may include a sensor installation unit 182 arranged to be piped with the first and second chambers 142*a* and 142*b* located on one side of the pump housing 141, a sensor cover 181 formed to enclose the outer side of the sensor installation unit 182, a sensor 183 installed on the sensor installation unit 182, and an electric wire 184 connected to the sensor 183 and arranged to deliver the measurement of whether there is a detergent and rinse from the sensor 183 to a controller (not shown).

Preferably, the sensor 183 may be arranged to come in contact with the detergent and rinse in the first and second chambers 142*a* and 142*b*. While it is illustrated in the embodiment that the sensor 183 is a screw, the present invention is not limited thereto.

Detection of whether there is a detergent and rinse may be displayed on the display unit 15 by the controller.

In the pump housing 141 of the detergent supply pump 140, an exhaust outlet 148 is arranged to be connected to the chamber 142 in order to exhaust the detergent and rinse. The exhaust outlet 148 includes a first exhaust outlet 148*a* piped with the first chamber 142*a* and a second exhaust outlet 148*b* piped with the second chamber 142*b*.

Piston members 146*a*, 146*b* arranged to apply pressure on the chamber 142 includes a first piston member 146*a* arranged in the first chamber 142*a* and a second piston member 146*b* arranged in the second chamber 142*b*.

The motor 143 and gear member 144 to drive the first and second piston members 146*a* and 146*b* may be arranged to correspond to each of the first piston member 146*a* and the second piston member 146*b*.

The first and second piston members 146*a* and 146*b* control internal pressure of the first chamber 142*a* and the second chamber 142*b*, in order for the detergent stored in the first chamber 142*a* and the rinse stored in the second chamber 142*b* to be discharged through the first and second exhaust outlets 148*a* and 148*b*, respectively.

The first piston member 146*a* connected to the first motor 143*a* moves up and down in the first chamber 142*a* to control the internal pressure of the first chamber 142*a*. A worm shaft 144*a* that is rotated while being connected to the first motor 143*a*, a worm gear 144*b* arranged to be rotated while being engaged with the worm shaft 144*a*, and a cam member 145 connected to the worm gear 144*b* to move the first piston member 146*a* may be arranged between the first piston member 146*a* and the first motor 143*a*. As the first motor 143*a* is rotated, the worm shaft 144*a* connected to the first motor 143*a* is rotated, the worm gear 144*b* connected to the worm shaft 144*a* is rotated, the cam member 146 connected to the worm gear 144*b* is rotated, and the piston member 146 connected to the cam member 145 applies pressure on the inside of the first chamber 142*a* while being moved.

According to a change in internal pressure of the first chamber 142*a*, the liquid detergent stored in the first reservoir 110*a* of the housing 110 flows to the first chamber 142*a* through the check valve 147, and the liquid detergent of the first chamber 142*a* is exhausted out of the detergent supply pump 140 through the first exhaust outlet 148*a*.

The detergent exhausted through the first exhaust outlet 148*a* is supplied to the first connection pipe 150 through the first detergent supply tube 161 connected to the first exhaust outlet 148*a*.

The operation of exhausting the rinse in the second chamber 142*b* through the second exhaust outlet 148*b* by the second motor 143*b* is similar to the operation of exhausting the detergent in the first chamber 142*a* through the first exhaust outlet 148*a* by the first motor 143*a*, so the detailed description of exhaust of the rinse will be omitted herein. The rinse exhausted through the second exhaust outlet 148*b* may be supplied to the first connection pipe 150 through the second detergent supply tube 162.

In the embodiment the detergent supply pump 140 is operated by the respective motor to move the piston member, but the present invention is not limited thereto. For example, it is also possible to selectively control the pressure in the chamber by driving a motor.

FIG. 19 schematically shows operation of an automatic detergent supply unit, according to an embodiment of the present invention.

Referring to FIG. 19, in a washing operation, water may be supplied by the water supply unit 16 to the tub 13, and a detergent stored in the first container 126*a* of the detergent box 120 may be supplied by the detergent supply pump 140 to the tub 13.

The detergent stored in the first container 126*a* of the detergent box 120 is moved by the detergent supply pump 140 to the first connection pipe 150 through the first exhaust outlet 148*a* and the first detergent supply tube 161. The detergent of the first connection pipe 150 is moved to the circulation pump 170 with the water exhausted from the tub 13, and supplied to the tub 13 through the second connection pipe 50. Washing may be performed using the detergent and water supplied into the tub 13. Once washing is done, water containing the detergent is exhausted by the exhaust unit 30.

In a rinsing operation, water may be supplied by the water supply unit 16 to the tub 13, and a rinse stored in the second container 126*b* of the detergent box 120 may be supplied by the detergent supply pump 140 to the tub 13.

The rinse stored in the second container 126*b* of the detergent box 120 is moved by the detergent supply pump 140 to the first connection pipe 150 through the second exhaust outlet 148*b* and the second detergent supply tube 162. The rinse of the first connection pipe 150 is moved to the circulation pump 170 with the water exhausted from the tub 13, and supplied to the tub through the second connection pipe 50. Rinsing of the laundry may be performed using the rinse and water supplied into the tub 13. Once rinsing is done, water containing the rinse is exhausted by the exhaust unit 30.

FIG. 20 is a perspective view of a first connection pipe, according to an embodiment of the present invention.

Referring to FIG. 20, one end 150*a* of the first connection pipe 150 in accordance with an embodiment of the present invention may be connected to the tub 13, and the other end 150*b* may be connected to the exhaust device 30. The detergent connection tube 153 is included in the first connection pipe 150 by being branched from the first connection pipe 150 and connected to the detergent supply pump 140. The first connection pipe 150 may further include a branch tube 155 connected to the pressure sensor 190 connected to the tub 13 for measuring an amount of water in the tub 13. Hereinafter, an extension from one end 150*a* of the first connection pipe 150 to the other end 150*b* may be termed a "first main connection pipe 150'".

The detergent connection tube 153 includes a first detergent connection tube 153*a* and a second detergent connection tube 153*b*. The detergent may be supplied to the first main connection pipe 150' through one of the first and second detergent connection tubes 153*a* and 153*b*, and the rinse may be supplied to the first main connection pipe 150' through the other one. An embodiment where the detergent is supplied through the first detergent connection tube 153*a* and the rinse is supplied through the second detergent connection tube 153*b* will now be described.

In a washing operation of the washing machine 1, the detergent contained in the first container 126*a* of the detergent box 120 is pumped by the detergent supply pump 140 and supplied to the first main connection pipe 150' through the first detergent connection tube 153*a*. The detergent supplied to the first main connection pipe 150' is moved to the exhaust unit 30 with the water supplied to the first main connection pipe 150'. The water containing the detergent may be pumped by the circulation pump 170 connected to the exhaust unit 30 and supplied into the tub 13 through the second connection pipe 50. The laundry may be washed with the water containing the detergent supplied into the tub 13.

In rinsing operation of the washing machine 1, the rinse contained in the second container 126*b* of the detergent box 120 is pumped by the detergent supply pump 140 and supplied to the first main connection pipe 150' through the second detergent connection tube 153*b*. The rinse supplied to the first main connection pipe 150' is moved to the exhaust unit 30 with the water supplied to the first main connection pipe 150'. The water containing the rinse may be pumped by the circulation pump 170 connected to the exhaust unit 30 and supplied into the tub 13 through the second connection pipe 50. The laundry may be rinsed with the water containing the rinse supplied into the tub 13.

In order to perform efficient laundry, a preset amount of detergent or rinse needs to be added into the tub 13 based on washing conditions such as a weight of the laundry, the volume of the water to be poured into the tub 13, or the like. Furthermore, only detergent needs to be put into the tub 13 in the washing operation, and only rinse needs to be put into the tub 13 in the rinsing operation. If a rinse is added into the tub 13 in the washing operation or a detergent is added into the tub 13 in the rinsing operation, interaction of the detergent and the rinse may badly affect efficient laundry.

In order for a preset amount of detergent or rinse to be supplied to the tub 13, the detergent or rinse needs to be supplied to the first main connection pipe 150' only when the detergent supply pump 140 is operating, and the supply of detergent or rinse needs to be blocked when the operation of the detergent supply pump 140 is stopped.

With the structure of the present invention, in which a detergent or rinse is pumped by the detergent supply pump 140 and supplied to the tub 13 through the detergent supply tubes 161, 162, the detergent connection tubes 153*a*, 153*b*, and the first main connection pipe 150', the remaining detergent or rinse left in the detergent supply tubes 161, 162 or the detergent connection tubes 153*a*, 153*b* may flow into the first main connection pipe 150' and may be added into the tub 13 with the water passing through the first main connection tube 150'.

In this case, a larger amount of detergent or rinse than the preset amount may be added to the tub 13, the remaining rinse left in the second detergent supply tube 162 or the second supply connection tube 153*b* may be added to the tub 13, or the remaining detergent or rinse left in the first detergent supply tube 161 or the first detergent connection tube 153*a* may be added to the tub 13, thereby hindering efficient washing.

FIGS. 21 and 22 are perspective views of a part of a first detergent connection tube, according to an embodiment of the present invention, and FIG. 23 shows a first connection pipe, a part of which is cut open, according to an embodiment of the present invention.

Referring to FIGS. 21 to 23, open/close units 157, 158 may be arranged in the detergent connection tube 153 in accordance with the embodiment of the present invention to selectively open or close the detergent connection tube 153. The open/close units 157, 158 may open the detergent connection tube 153 only when the detergent supply pump 140 is operating, and may block the detergent connection tube 153 when the operation of the detergent supply pump 140 is stopped. The open/close units 157, 158 may be arranged in a part where the detergent connection tube 153 and the first main connection pipe 150' are connected. The open/close units 157, 158 may be insert-injection molded by being inserted in the injection molding. The first detergent connection tube 153*a* to supply the detergent may include the first open/close unit 157, and the second detergent connection tube 153*b* to supply the rinse may include the second open/close unit 158. As for the second open/close unit 158, the structure of the first open/close unit 157 may be similarly applied thereto, and thus the description about the structure of the first open/close unit 157 will now be described.

The first open/close unit 157 includes a first blocking unit 157*a* arranged to selectively open the first detergent connection tube 153*a*, and a second blocking unit 157*b* connected to the first blocking unit 157*a* for blocking an internal part of the first detergent connection tube 153*a*. The first and second blocking units 157*a* and 157*b* may be formed of a flexible material like rubber, and may be formed into one unit.

The second blocking unit 157*b* is fixed on the internal side of the first detergent connection tube 153*a*, and the first blocking unit 157*a* is formed to protrude from the center of the second blocking unit 157*b* in the direction of length of the first detergent connection tube 153*a*. That is, the first blocking unit 157*a* may extend by protruding in the movement direction of the detergent flowing in the first detergent connection tube 153*a*. In a case where the first open/close unit 157 is located in the connection part of the first main connection pipe 150' and the first detergent connection tube 153*a*, the first blocking unit 157*a* may protrude toward the first main connection pipe 150'. The second blocking unit 157*b* is arranged to block the movement of the detergent flowing in the first detergent connection tube 153*a*.

In the first blocking unit 157*a*, an opening 159 that is selectively opened so as to be selectively piped with the first detergent connection tube 153*a* and the first main connection pipe 150'. The opening 159 remains closed as long as there is no external force applied to the first or second blocking unit 157*a* or 157*b*. When the detergent supply pump 140 is operating and thus the detergent presses a side of the second blocking unit 157*b*, the second blocking unit 157*b* is pushed and the opening 159 may be opened.

When the detergent supply pump 140 is not operating, the first blocking unit 157*a* remains closed as its internal sides come in contact with each other not to form the opening 159, as shown in FIG. 17. At this time, the first detergent connection tube 153*a* is blocked by the first and second blocking units 157*a* and 157*b*, and thus the first detergent connection tube 153*a* and the first main connection pipe 150' are not piped with each other. This may prevent the remaining detergent left in the first detergent connection tube 153*a* from flowing into the first main connection pipe 150' even when water is flowing into the first main connection pipe 150'.

When the detergent supply pump 140 pumps the detergent contained in the detergent box 120, the detergent that passed through the first detergent supply tube 161 is supplied to the first connection tube 153*a*, and the detergent supplied to the first detergent connection tube 153*a* by the pumping pressure of the detergent supply pump 140 presses a side of the second blocking unit 157*b*. The opening 159 of the first blocking unit 157*a* may be opened as the second blocking unit 157*b* is pushed by the pressure applied on the side of the second blocking unit 157*b*, toward the first main connection pipe 150'. The detergent of the first detergent connection tube 153*a* may be supplied to the first main connection pipe 150' through the opening 159 formed in the first blocking unit 157*a*.

The detergent supply pump 140 stops its operation after pumping the set amount of detergent. When the operation of the detergent supply pump 140 is stopped, there is no external force applied on the second blocking unit 157*b* and accordingly, the second blocking unit 157*b* is returned to the position before the second blocking unit 157*b* was pressed and the opening 159 of the first blocking unit 157*a* is closed. This may block the first detergent connection tube 153*a* and prevent the remaining detergent left in the first detergent connection tube 153*a* from being supplied to the first main connection pipe 150'. The detergent may be supplied to the first main connection pipe 150' only when the detergent supply pump 140 is operating by the first open/close unit 157.

FIG. 24 shows supply of a detergent into a first connection pipe, according to an embodiment of the present invention, and FIG. 25 shows supply of a rinse into a first connection pipe, according to an embodiment of the present invention.

Referring to FIGS. 24 and 25, in washing operation of the washing machine 1 in accordance with an embodiment of the present invention, the detergent supply pump 140 pumps the detergent contained in the detergent box 120. The pumped detergent may press a side of the second blocking unit 157*b*, to open the opening 159 formed in the first blocking unit 157*a*. As the opening 159 is opened, the first detergent connection tube 153*a* and the first main connection pipe 150' may be piped. The detergent pumped by the detergent supply pump 140 may be supplied to the first main connection pipe 150' through the first detergent supply tube 161 and the first detergent connection tube 153*a*. The detergent supplied to the first main connection pipe 150' may be moved to the exhaust unit 30 with the water flowing from the tub 13, and may flow into the tub 13 by pumping of the circulation pump 170. Accordingly, water containing the detergent may flow into the tub 13.

When the operation of the detergent supply pump 140 is stopped after the set amount of detergent is pumped, the pressing force on the first open/close unit 157 disappears and thus, the opening 159 may be closed. This isolates the first detergent connection tube 153*a* from the first main connection pipe 150', thereby stopping to supply the detergent to the first main connection pipe 150'.

Similar to the occasion when the detergent is pumped, the detergent supply pump 140 may pump the rinse contained in the detergent box 120 in rinsing operation of the washing machine 1. The pumped rinse may press a side of a fourth blocking unit 158*b*, to open an opening formed in a third blocking unit 158*a*. As the opening is opened, the second detergent connection tube 153*b* and the first main connection pipe 150' may be piped. The rinse pumped by the detergent supply pump 140 may be supplied to the first main connection pipe 150' through the second detergent supply tube 162 and the second detergent connection tube 153*b*. The rinse supplied to the first main connection pipe 150' may be moved to the exhaust unit 30 with the water flowing from the tub 13, and may flow into the tub 13 by a pumping operation of the circulation pump 170. Accordingly, water containing the rinse may flow into the tub 13.

When the operation of the detergent supply pump 140 is stopped after the set amount of rinse is pumped, the pressing force on the fourth blocking unit 158*a* disappears and thus, the opening may be closed. This isolates the second detergent connection tube 153*b* from the first main connection pipe 150', thereby stopping to supply the rinse to the first main connection pipe 150'.

As such, an amount of detergent or rinse flowing into the tub 13 may be easily controlled by enabling the detergent or rinse to be supplied only when the detergent supply pump 140 is operating and enabling supply of the detergent or rinse to the first main connection pipe 150' to be stopped immediately when the operation of the detergent supply pump 140 is stopped. Accordingly, in washing or rinsing operation of the washing machine 1, the set amount of detergent or rinse is supplied to the tub 13, thereby performing washing or rinsing efficiently.

Furthermore, when the detergent supply pump 140 is not operating, the detergent connection tubes 153*a*, 153*b* and the first main connection pipe 150' are isolated from each other by means of the open/close units 157, 158, thereby preventing the water flowing into the first main connection pipe 150' from flowing back to the detergent connection tubes 153*a*, 153*b*.

While the disclosure has been shown and described with reference to certain exemplary embodiments thereof, it will be understood by those skilled in the art that various changes in form and details may be made therein without departing from the spirit and scope of the invention as defined by the appended claims and their equivalents.

The invention claimed is:

1. A washing machine comprising:

a housing for detachably housing a detergent box and comprises a valve pressure protrusion configured to move between an up position and a down position;

the detergent box for containing a detergent or rinse, the detergent box including:

an exhaust valve located at a base surface of the detergent box, wherein the exhaust valve forms an exhaust fluid path;

a plunger configured to:

when the valve pressure protrusion is in the up position:

open the exhaust fluid path as the detergent box is inserted into the housing, and close the exhaust fluid path as the detergent box is removed from the housing, and when the valve pressure protrusion is in the down position, close the exhaust fluid path;

a detergent supply pump comprising a first detergent supply tube for pumping the detergent and a second detergent supply tube for pumping the rinse contained in the detergent box; and a connection pipe including:

a main connection pipe connecting an output of a tub of the washing machine to an input of a circulation pump, a detergent connection tube branched from the main connection pipe before the circulation pump and comprising:

a first detergent connection tube connected to the first detergent supply tube of the detergent supply pump, and a second detergent connection tube connected to the second detergent supply tube of the detergent supply pump, and a two part valve for opening or closing one of the first detergent connection tube or the second detergent connection tube in relation to the main connection pipe, wherein the two part valve is configured to:

open one of the first detergent connection tube or the second detergent connection tube when the detergent supply pump is operated to pump the detergent or rinse, and block one of the first detergent connection tube or the second detergent connection tube in order not to supply the detergent or rinse to the main connection pipe when the detergent supply pump is not operating.

2. The washing machine of claim 1, wherein the two part valve is opened by a force of the detergent or rinse pumped by the detergent supply pump, which presses a side of the two part valve.

3. The washing machine of claim 1, wherein the two part valve comprises:

a first blocking unit with an opening formed thereon and opposite internal sides to come into contact with each other, and a second blocking unit connected to the first blocking unit and fixed on an internal side of the connection pipe.

4. The washing machine of claim 3, wherein the connection pipe is blocked by the opposite internal sides of the first blocking unit coming into contact and being closed, if the detergent supply pump is not operating.

5. The washing machine of claim 3, wherein at least parts of the opposite internal sides of the first blocking unit are separated and opened by a force of the detergent or rinse pumped by the detergent supply pump pressing a connected part between the first blocking unit and the second blocking unit.

6. The washing machine of claim 5, wherein the detergent or rinse pumped by the detergent supply pump is supplied into the connection pipe if the opening of the first blocking unit is opened and the at least parts of the opposite internal sides of the first blocking unit are separated.

7. The washing machine of claim 5, wherein the opposite internal sides of the first blocking unit are closed by being returned to positions before they were pressed, if operation of the detergent supply pump is stopped.

8. The washing machine of claim 1, wherein the two part valve is equipped in one of the first detergent connection tube or the second detergent connection tube.

9. The washing machine of claim 1, wherein:

the detergent is pumped and supplied to the first detergent connection tube, and the rinse is pumped and supplied to the second detergent connection tube.

10. The washing machine of claim 9, wherein the two part valve comprises:

a first part valve equipped in the first detergent connection tube, and a second part valve equipped in the second detergent connection tube.

11. The washing machine of claim 10, wherein the first or second part valve has the first or second detergent connection tube selectively piped with the main connection pipe.

12. The washing machine of claim 1, wherein:

the exhaust valve is arranged in a detergent discharger of the detergent box, and the exhaust valve comprises a valve case arranged in the detergent discharger to form the exhaust fluid path.

13. The washing machine of claim 12, further comprising:

an anti-leakage seal arranged on a bottom of the exhaust valve for guiding the exhaust valve to be combined with a detergent inlet of the housing, thereby preventing leakage of a liquid detergent.

14. A washing machine comprising:

a housing for detachably housing a detergent box and comprises a valve pressure protrusion configured to move between an up position and a down position;

the detergent box for containing a detergent or rinse, the detergent box including:

an exhaust valve forming an exhaust fluid path;

a plunger configured to:

when the valve pressure protrusion is in the up position:

open the exhaust fluid path as the detergent box is inserted into the housing, and close the exhaust fluid path as the detergent box is removed from the housing, and when the valve pressure protrusion is in the down position, close the exhaust fluid path;

a detergent supply pump comprising a first detergent supply tube for pumping the detergent and a second detergent supply tube for pumping the rinse contained in the detergent box;

a connection pipe including:

a main connection pipe connecting an output of a tub of the washing machine to an input of a circulation pump, and a detergent connection tube branched from the main connection pipe before the circulation pump and comprising:

a first detergent connection tube connected to the first detergent supply tube of the detergent supply pump, and a second detergent connection tube connected to the second detergent supply tube of the detergent supply pump; and the exhaust valve for opening or closing a detergent discharger arranged in the detergent box and a detergent inlet arranged in the housing, wherein the exhaust valve includes a valve case arranged in the detergent discharger for forming the exhaust fluid path, and wherein the plunger blocks a bottom of the valve case when the detergent discharger is blocked.

15. The washing machine of claim 14, wherein:

the valve case comprises a plunger supporter for supporting a back end of the plunger, and the bottom of the valve case is blocked when the back end of the plunger is supported by the plunger supporter.

16. The washing machine of claim 14, wherein:

the valve pressure protrusion is able to press the plunger, and the detergent discharger and the detergent inlet are piped when the plunger is pressed by the valve pressure protrusion.

17. The washing machine of claim 14, wherein:

the connection pipe comprises a two part valve for opening the connection pipe when the detergent or rinse is pumped by the detergent supply pump, and the two part valve is configured to block the connection pipe in order not to supply the detergent or rinse to the connection pipe when the detergent supply pump is not operating.

* * * * *